US012000602B2

(12) United States Patent
Hayashi et al.

(10) Patent No.: US 12,000,602 B2
(45) Date of Patent: Jun. 4, 2024

(54) AIR-CONDITIONING APPARATUS

(71) Applicant: Mitsubishi Electric Corporation, Tokyo (JP)

(72) Inventors: Hiroyasu Hayashi, Tokyo (JP); Takuya Teramoto, Tokyo (JP); Hidetoshi Seki, Tokyo (JP); Masahiko Takagi, Tokyo (JP); Kazuki Watanabe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 18/248,475

(22) PCT Filed: Nov. 27, 2020

(86) PCT No.: PCT/JP2020/044258
§ 371 (c)(1),
(2) Date: Apr. 10, 2023

(87) PCT Pub. No.: WO2022/113279
PCT Pub. Date: Jun. 2, 2022

(65) Prior Publication Data

US 2023/0375194 A1 Nov. 23, 2023

(51) Int. Cl.
*F04D 29/30* (2006.01)
*F04D 29/42* (2006.01)
*F24F 1/0022* (2019.01)

(52) U.S. Cl.
CPC ..... *F24F 1/0022* (2013.01); *F04D 29/30* (2013.01); *F04D 29/422* (2013.01); *F04D 29/4226* (2013.01)

(58) Field of Classification Search
CPC ..... F24F 1/0022; F24F 13/20; F04D 29/282; F04D 29/283; F04D 29/422; F04D 29/4226
See application file for complete search history.

(56) References Cited

U.S. PATENT DOCUMENTS 7,461,518 B2 * 12/2008 Higashida ..... F04D 29/4213 62/414

FOREIGN PATENT DOCUMENTS

JP H04-009520 U 1/1992
JP H06-058564 A 3/1994
(Continued)

OTHER PUBLICATIONS

International Search Report of the International Searching Authority dated Dec. 28, 2020 for the corresponding International Application No. PCT/JP2020/044258 (and English translation).

*Primary Examiner* — Justin D Seabe
(74) *Attorney, Agent, or Firm* — Posz Law Group, PLC

(57) ABSTRACT

An air-conditioning apparatus includes: a centrifugal air-sending device including a fan and a scroll casing having a tongue portion and a discharge portion, and a housing having a housing suction port and a discharge portion. A trailing edge of a blade located closest to a wall portion of the housing is a first trailing edge portion, and a leading edge of a blade located closest to the tongue portion is a first leading edge portion. In a first region, a boundary portion located closest to the tongue portion is located between first and second straight lines. The first straight line passes through a rotation axis of the fan and the first trailing edge portion, the second straight line is parallel to the first straight line and passes through the first leading edge portion, and the first region forms part of the housing suction port close to the tongue portion.

5 Claims, 18 Drawing Sheets

(56) References Cited

FOREIGN PATENT DOCUMENTS

| | | | | |
|---|---|---|---|---|
| JP | 2000240590 | A | * | 9/2000 |
| JP | 2005155580 | A | * | 6/2005 |
| JP | 2010216294 | A | * | 9/2010 |
| JP | 2011226410 | A | * | 11/2011 |

* cited by examiner

Comparative Example

Comparative Example

AIR-CONDITIONING APPARATUS

CROSS-REFERENCE TO RELATED APPLICATION

This application is a U.S. national stage application of PCT/JP2020/044258 filed on Nov. 27, 2020, the contents of which are incorporated herein by reference.

TECHNICAL FIELD

The present disclosure relates to an air-conditioning apparatus provided with a centrifugal air-sending device including a scroll casing and a fan.

BACKGROUND ART

Some existing air-conditioning apparatuses are each provided with an air suction port through which air flows thereinto and which is provided at a position shifted by 90 degrees from a discharge port of a scroll casing of a centrifugal air-sending device that is housed in the air-conditioning apparatus (see, for example, Patent Literature 1). At the air suction port, in order to prevent dirt and dust from entering the air suction port, a filter is fixedly attached to a decorative panel of a housing of the air-conditioning apparatus. In a centrifugal air-sending device that is, for example, a sirocco fan, a fan is rotated to cause air to flow into the scroll casing, and can obtain a pressure-raising effect since an air passage in the scroll casing is expanded from an upstream side toward a downstream side in the flow direction of air.

CITATION LIST

Patent Literature

Patent Literature 1: Japanese Unexamined Patent Application Publication No. 6-58564

SUMMARY OF INVENTION

Technical Problem

In existing centrifugal air-sending devices, a tongue portion from which the air passage starts to expand makes noise, when an air current passes through the tongue portion. This is because at the tongue portion, the flow passage is narrow, and the air current thus flows at a higher velocity through the tongue portion. When the noise made by the tongue portion propagates to the outside, sound is attenuated by decorative panels forming the housing, whereas sound is not greatly attenuated at the filter attached to the air suction port. In view of this point, in some cases, an air suction port is provided at a position located apart from a scroll casing of a centrifugal air-sending device, as in the air-conditioning apparatus of Patent Literature 1. In this case, the air-conditioning apparatus has a larger housing to ensure a given distance between the scroll casing and the air suction port.

Furthermore, in the case of reducing the space for installation of the air-conditioning apparatus, the air-conditioning apparatus is made smaller, and the air suction port is provided closer to the scroll casing. As a result, noise made from the tongue portion easily leaks out through the air suction port and a larger amount of noise can be made from the air-conditioning apparatus. Furthermore, in the case where the air suction port is made smaller, noise made from the tongue portion does not easily leak out through the air suction port, but the amount of air that is sucked into the centrifugal air-sending device is decreased, and the amount of air that is sent from the centrifugal air-sending device and passes through a heat exchanger is also decreased.

The present disclosure is applied to solve the above problem, and relates to an air-conditioning apparatus that does not increase noise while ensuring that an air suction port of a housing has a given size in order that the amount of air that is sucked into a centrifugal air-sending device should not be greatly reduced even in the case where the air-conditioning apparatus is made smaller.

Solution to Problem

An air-conditioning apparatus according to an embodiment of the present disclosure includes: a centrifugal air-sending device including a fan and a scroll casing, the fan including a main plate that is driven to rotate and a plurality of blades provided at a circumferential edge portion of the main plate, the scroll casing accommodating the fan and including a circumferential wall and a side wall, the circumferential wall being formed in the shape of a scroll, the side wall having a suction port that communicates with a space defined by the main plate and the plurality of blades; a heat exchanger through which an air current generated from the centrifugal air-sending device passes; and a housing that houses the centrifugal air-sending device and the heat exchanger, and has a housing suction port through which air is sucked into the centrifugal air-sending device and a housing air outlet through which air that is sent from the centrifugal air-sending device and passes through the heat exchange flows out from the housing. The scroll casing has: a tongue portion located at a position from which the circumferential wall extends to be formed in the shape of the scroll, the tongue portion being configured to divide a flow of air blown from the fan; and a discharge portion having a discharge port through which air blown from the fan flows out. The housing has an opening wall portion having the housing suction port, and the housing suction port is located on a line crossing a direction in which the discharge port extends. Where as viewed in a direction along a rotation axis of the fan, in a radial direction perpendicular to the rotation axis, a trailing edge of one of the plurality of blades that is located closest to a wall portion of the housing is defined as a first trailing edge portion, and a leading edge of one of the plurality of blades that is located closest to the tongue portion is defined as a first leading edge portion; a straight line that passes through the rotation axis and the first trailing edge portion is defined as a first straight line, and a straight line that is parallel to the first straight line and passes through the first leading edge portion is defined as a second straight line; and a region that forms part of the housing suction opening that is close to the tongue portion with reference to the rotation axis is defined as a first region, a boundary portion of the first region that is located closest to the tongue portion is located between the first straight line and the second straight line.

Advantageous Effects of Invention

According to the embodiment of the present disclosure, in the air-conditioning apparatus, the boundary portion of the first region that is located closest to the tongue portion in the first region is located between the first straight line and the second straight line. In the air-conditioning apparatus, the wall portion of the housing covers the tongue portion at a positon located below the tongue portion in the vertical direction, since the boundary portion is located apart from a position located under the tongue portion in the vertical direction while it is ensured that the housing suction port has a given size in the case where the housing is made smaller. Therefore, in the air-conditioning apparatus, noise made by the tongue portion can be attenuated by the wall portion of the housing.

DESCRIPTION OF EMBODIMENTS

An air-conditioning apparatus according to each of embodiments will be described with reference to the drawings, etc. In figures including FIG. 1 that will be referred to below, relative relationships in dimension between components, the shapes of the components, or other features of the components may be different from actual ones. Furthermore, in each of the figures, components that are the same as or equivalent to those in a previous figure or previous figures are denoted by the same reference signs, and the same is true of the entire text of the specification. In addition, terms related to directions (for example, "upper", "lower", "right", "left", "front", and "back") are used as appropriate in order that descriptions be easily understood, and these terms are used merely as a matter of convenience for explanation, and are not intended to limit the location or orientation of each of devices or components.

Embodiment 1

[Centrifugal Air-Sending Device 100]

Figure 1:
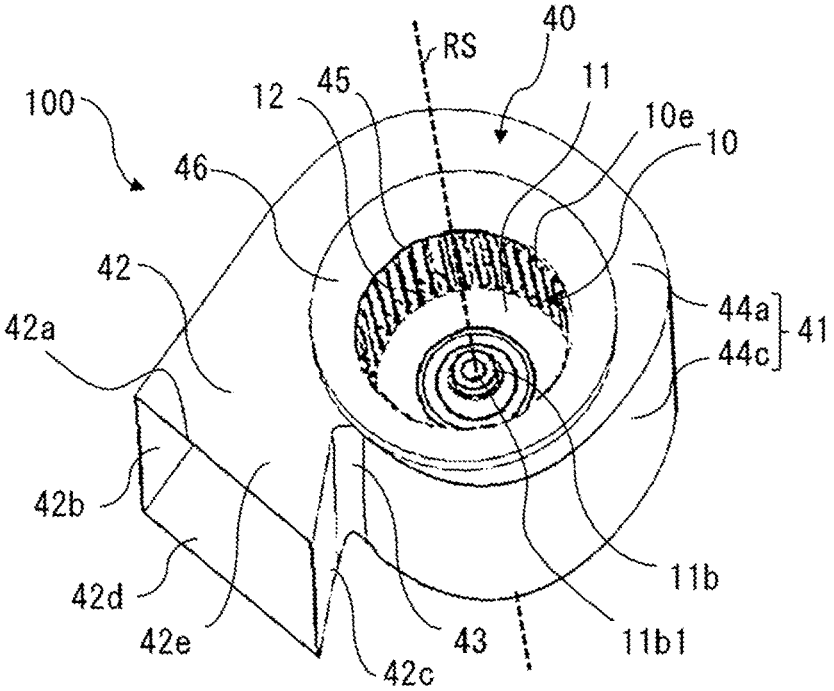
FIG. 1 is a perspective view schematically illustrating a centrifugal air-sending device according to Embodiment 1.
Figure 2:
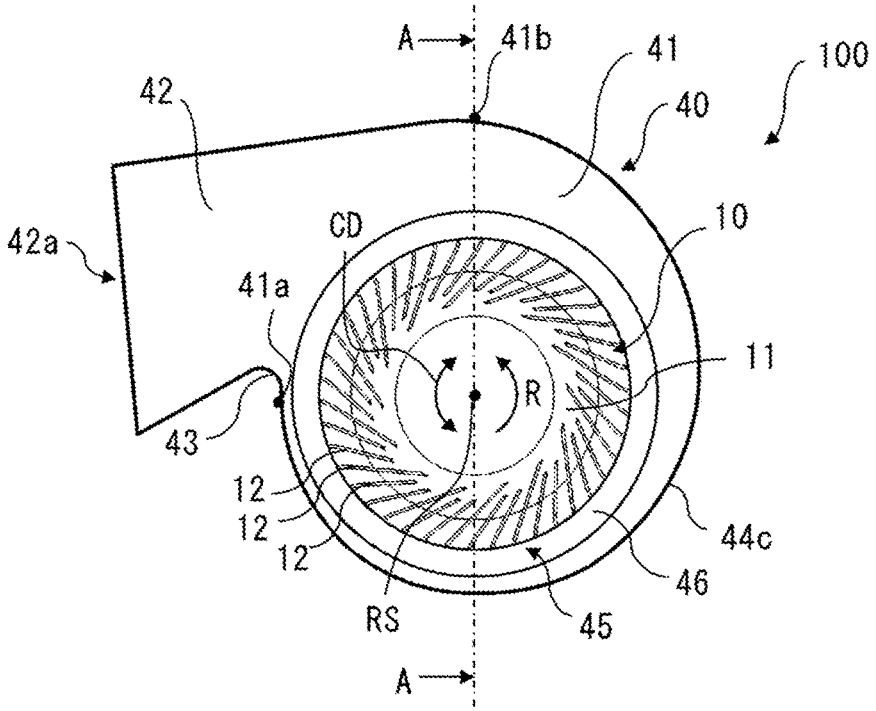
FIG. 2 is an external view schematically illustrating a configuration of the centrifugal air-sending device according to Embodiment 1 as viewed in a direction parallel to a rotation axis.
Figure 3:
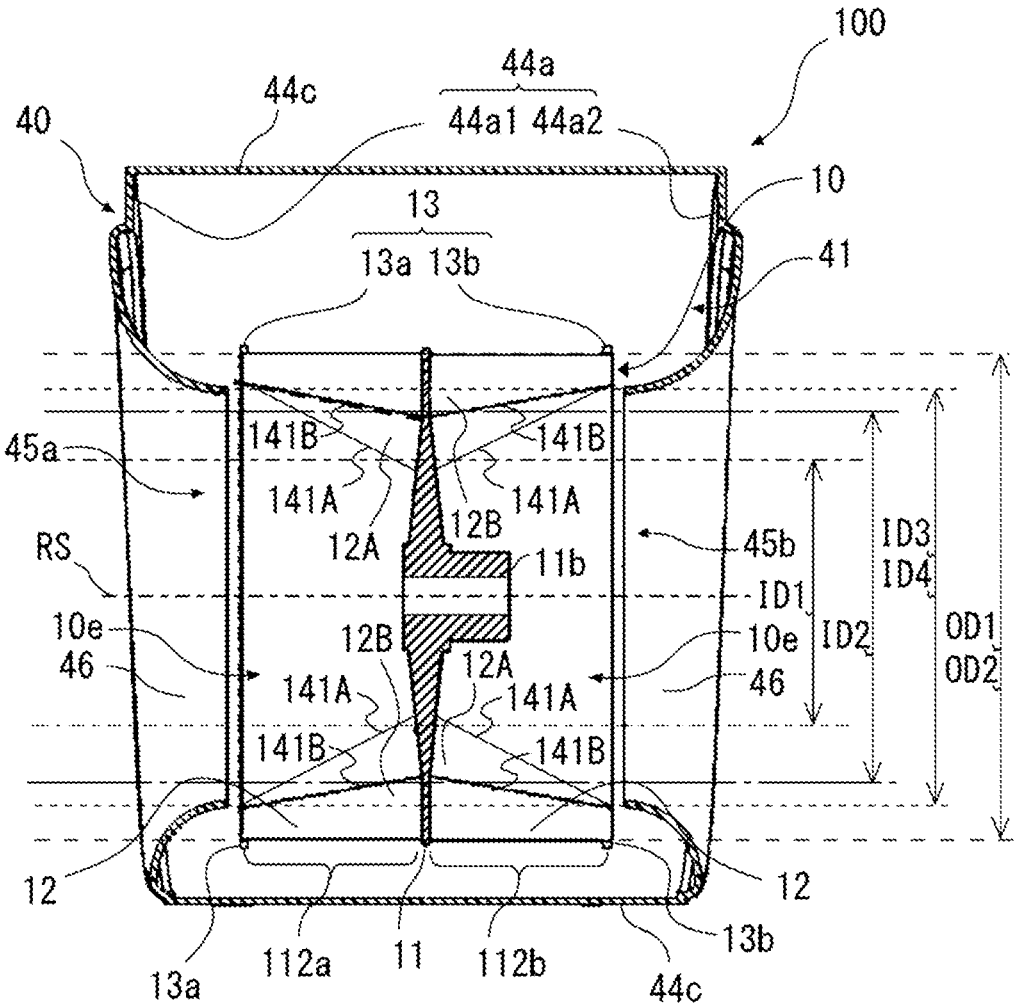
FIG. 3 is a schematic sectional view of the centrifugal air-sending device that is taken along line A-A in FIG. 2.

FIG. 1 is a perspective view schematically illustrating a centrifugal air-sending device 100 according to Embodiment 1. FIG. 2 is an external view schematically illustrating a configuration of the centrifugal air-sending device 100 according to Embodiment 1 as viewed in a direction parallel to a rotation axis RS. FIG. 3 is a schematic sectional view of the centrifugal air-sending device 100 that is taken along line A-A in FIG. 2. A basic configuration of the centrifugal air-sending device 100 will be described with reference to FIGS. 1 to 3.

The centrifugal air-sending device 100 is a multi-blade centrifugal air-sending device such as a sirocco fan, and includes a fan 10 that generates an air current and a scroll casing 40 that accommodates the fan 10. The centrifugal air-sending device 100 is a double-suction centrifugal air-sending device into which air is sucked from both sides of the scroll casing 40 in an axial direction along an imaginary rotation axis RS of the fan 10. Alternatively, the centrifugal air-sending device 100 may be a single-suction centrifugal air-sending device into which air is sucked from one of the both sides of the scroll casing 40 in the axial direction along the imaginary rotation axis RS of the fan 10.

[Scroll Casing 40]

The scroll casing 40 accommodates the fan 10 for use in the centrifugal air-sending device 100, and rectifies the flow of air sent from the fan 10. The scroll casing 40 includes a scroll portion 41 and a discharge portion 42.

(Scroll Portion 41)

The scroll portion 41 has an air passage through which a dynamic pressure of an air current generated by the fan 10 is converted into a static pressure. The scroll portion 41 has an internal air passage that is expanded from an upstream side toward a downstream side in the flow direction of air, in the rotation direction of the fan 10. The scroll portion 41 has side walls 44*a* and a circumferential wall 44*c*. The side walls 44*a* cover the fan 10 in an axial direction along the rotation axis RS of a boss portion 11*b* of the fan 10 and have suction ports 45 through which air flows into the scroll portion 11. The circumferential wall 44*c* surrounds the fan 10 while covering the fan 10 in a radial direction perpendicular to the rotation axis RS of the boss portion 11*b*.

Furthermore, the scroll portion 41 has a tongue portion 43 that is located between the discharge portion 42 and a scroll start portion 41*a* of the circumferential wall 44*c* in such a manner as to form a curved surface, and that guides an air current generated by the fan 10 to a discharge port 42*a* of the discharge portion 42 through the scroll portion 41. It should be noted that the radial direction perpendicular to the rotation axis RS is a direction perpendicular to the axial direction along the rotation axis RS. An internal space of the scroll portion 41 that is defined by the circumferential wall 44*c* and the side walls 44*a* is a space in which air sent from the fan 10 flows along the circumferential wall 44*c*.

(Side Wall 44*a*)

The side walls 44*a* are provided on respective sides of the fan 10, that is, both sides of the fan 10 in the axial direction along the rotation axis RS of the fan 10. The side walls 44*a* of the scroll casing 40 each have the suction port 45 to allow air to flow between the fan 10 and the outside of the scroll casing 40.

The scroll casing 40 of the centrifugal air-sending device 100 is a double-suction casing that has the side walls 44*a* provided with the suction ports 45 on both sides of the main plate 11 in the axial direction along the rotation axis RS of the boss portion 11*b*. Alternatively, the scroll casing 40 may be a single-suction casing that has a side wall 44*a* provided with an suction port 45 on one of the both sides of the main plate 11 in the axial direction along the rotation axis RS of the boss portion 11*b*.

The suction port 45 of each of the side walls 44*a* is defined by a bellmouth 46. To be more specific, the bellmouth 46 defines the suction port 45, which communicates with the space defined by the main plate 11 and a plurality of blades 12. The bellmouth 46 rectifies air that is sucked into the fan 10 and allows the air to flow into suction ports 10*e* of the fan 10.

The bellmouth 46 has an opening whose diameter gradually decreases from the outside toward the inside of the scroll casing 40. By virtue of the configuration of the side walls 44*a*, air in the vicinity of each of the suction ports 45 smoothly flows along the bellmouth 46 and efficiently flows into the fan 10 through the suction port 45.

(Circumferential Wall 44*c*)

The circumferential wall 44*c* is a wall that guides an air current generated by the fan 10 toward the discharge port 42*a* along its curved wall surface. The circumferential wall 44*c* is provided between the side walls 44*a* which faces each other, and has a curved surface extending along the rotation direction R of the fan 10. The circumferential wall 44*c* is, for example, provided parallel to the axial direction along the rotation axis RS of the fan 10 to cover the fan 10. It should be noted that the circumferential wall 44*c* may be inclined relative to the axial direction along the rotation axis RS of the fan 10, and is not limited to the circumferential wall provided parallel to the axial direction along the rotation axis RS.

The circumferential wall 44*c* covers the fan 10 in the radial direction of the boss portion 11*b*, and forms an inner circumferential surface of the fan 10 that faces an air-blowing side of each of a plurality blades 12 (to be described later) of the fan 10, from which air is blown. As illustrated in FIG. 2, the circumferential wall 44*c* is provided to extend along the rotation direction R of the fan 10, over an area that is located from the scroll start portion 41*a*, which is located at a boundary between the circumferential wall 44*c* and the tongue portion 43, to a scroll end portion 41*b*, which is located at a boundary between the discharge portion 42 and the scroll portion 41 on a side located apart from the tongue portion 43.

The scroll start portion 41*a* is an end portion of the circumferential wall 44*c* on an upstream side in the flow direction of air that is made to flow, by rotation of the fan 10, along the circumferential wall 44*c* in the internal space of the scroll casing 40. The scroll end portion 41*b* is an end portion of the circumferential wall 44*c* on a downstream side in the flow direction of air that is made to flow by the rotation of the fan 10 along the circumferential wall 44*c* in the internal space of the scroll casing 40.

The circumferential wall 44*c* is formed in the shape of a scroll. The shape of the scroll is a shape, for example, based on a logarithmic spiral, an Archimedean spiral, or an involute curve. An inner circumferential surface of the circumferential wall 44*c* forms a curved surface that is smoothly curved along a circumferential direction of the fan 10 from the scroll start portion 41*a*, from which the circumferential wall 44*c* extends to be formed in the shape of the scroll, to the scroll end portion 41*b*, to which the circumferential wall 44*c* extends to be formed in the shape of the scroll. By virtue of such a configuration, air sent from the fan 10 smoothly flows through the space between the fan 10 and the circumferential wall 44*c* in a direction toward the discharge portion 42. Thus, in the scroll casing 40, the static pressure of air from the tongue portion 43 toward the discharge portion 42 efficiently rises.

(Discharge Portion 42)

The discharge portion 42 has a discharge port 42*a* from which air sent from the fan 10 and having passed through the scroll portion 41 is discharged. The discharge portion 42 is a hollow pipe having a rectangular section orthogonal to the flow direction of air flowing along the circumferential wall 44*c*. It should be noted that the sectional shape of the discharge portion 42 is not limited to a rectangle. The discharge portion 42 has a flow passage through which air sent from the fan 10 and flowing through the space between the circumferential wall 44*c* and the fan 10 is guided to flow out to the outside of the scroll casing 40.

As illustrated in FIG. 1, the discharge portion 42 includes an extension plate 42*b*, a diffuser plate 42*c*, a first side plate portion 42*d*, a second side plate portion 42*e*, and other components. The extension plate 42*b* is formed integrally with the circumferential wall 44*c* such that the extension plate 42*b* is smoothly continuous with the scroll end portion 41*b*, which is located on a downstream side of the circumferential wall 44*c*. The diffuser plate 42*c* is formed integrally with the tongue portion 43 of the scroll casing 40 and faces the extension plate 42*b*. The diffuser plate 42*c* is formed at a predetermined angle relative to the extension plate 42*b* such that the sectional area of a flow passage gradually increases along the flow direction of air that flows in the discharge portion 42.

The first side plate portion 42*d* is formed integrally with one of the side walls 44*a* which is located on one side in the axial direction along the rotation axis RS, and the second side plate portion 42*e* is formed integrally with the other side wall 44*a* located on the other side in the axial direction along the rotation axis RS. Moreover, the first side plate portion 42*d* and the second side plate portion 42*e* are formed between the extension plate 42*b* and the diffuser plate 42*c*. In such a manner, the discharge portion 42 has a flow passage that has a rectangular section and is defined by the extension plate 42*b*, the diffuser plate 42*c*, the first side plate portion 42*d*, and the second side plate portion 42*e*.

(Tongue Portion 43)

In the scroll casing 40, the tongue portion 43 is formed between the diffuser plate 42*c* of the discharge portion 42 and the scroll start portion 41*a* of the circumferential wall 44*c*. The tongue portion 43 is located at a position from which the circumferential wall 44*c* extends to be formed in the shape of the scroll, and divides the flows of air sent from the fan 10. The tongue portion 43 is formed to have a predetermined radius of curvature, and the circumferential wall 44*c* smoothly connects with the diffuser plate 42*c*, with the tongue portion 43 interposed between the circumferential wall 44*c* and the diffuser plate 42*c*.

The tongue portion 43 reduces inflow of air from a scroll start of a scroll flow passage to a scroll end of the scroll flow passage. The tongue 43 is located at an upstream part of a ventilation passage provided in the scroll casing 40, and has a role to divide the flow of air into a flow of air that flows in the rotation direction R of the fan 10 and a flow of air that flows in a discharge direction from a downstream part of the ventilation passage toward the discharge port 42*a*. Furthermore, the static pressure of air that flows into the discharge portion 42 rises to a higher pressure than the pressure in the scroll casing 40, while the air is passing through the scroll casing 40. Therefore, the tongue portion 43 has a function of separating such different pressures.

[Fan 10]

Figure 4:
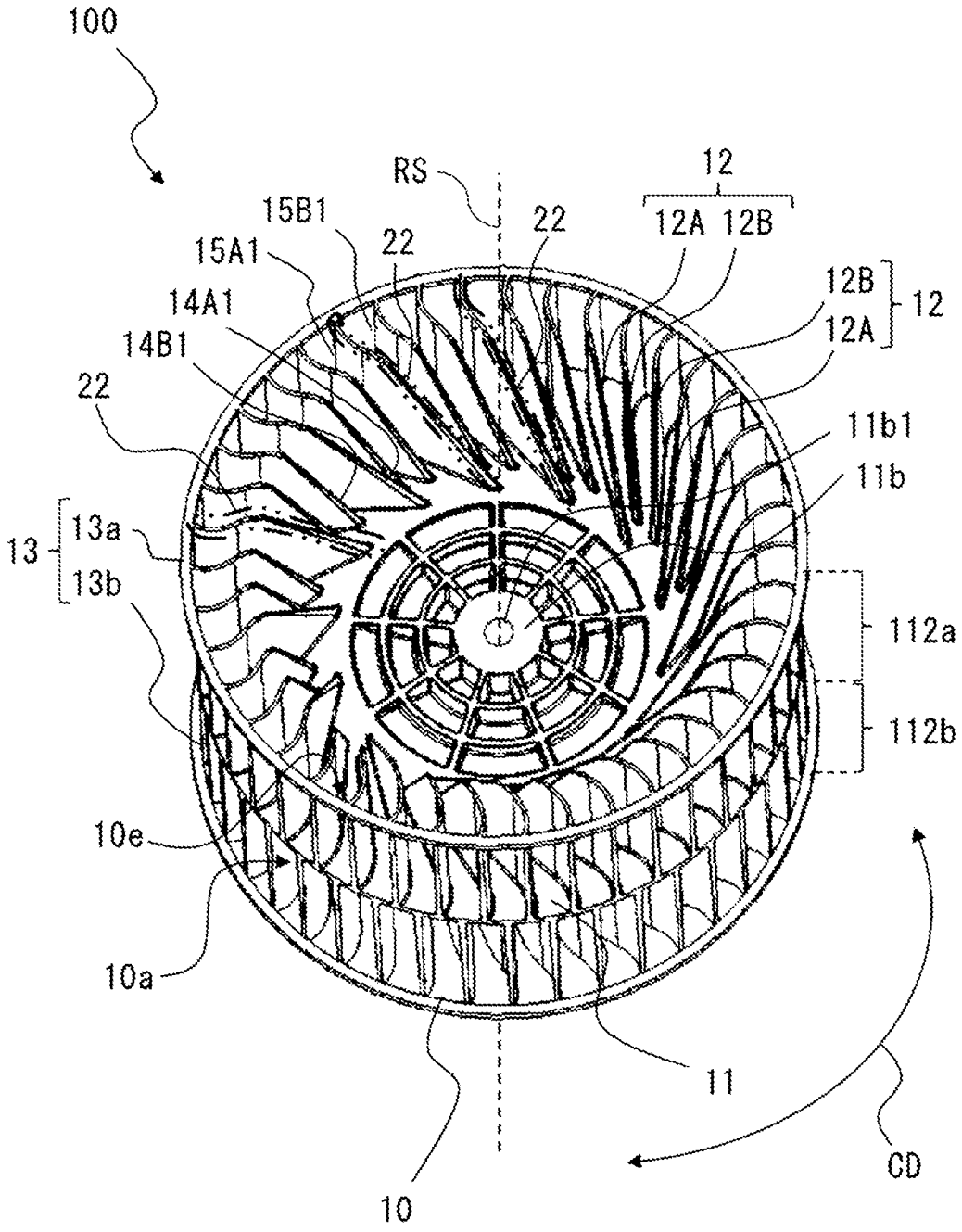
FIG. 4 is a perspective view of a fan of the centrifugal air-sending device according to Embodiment 1.
Figure 5:
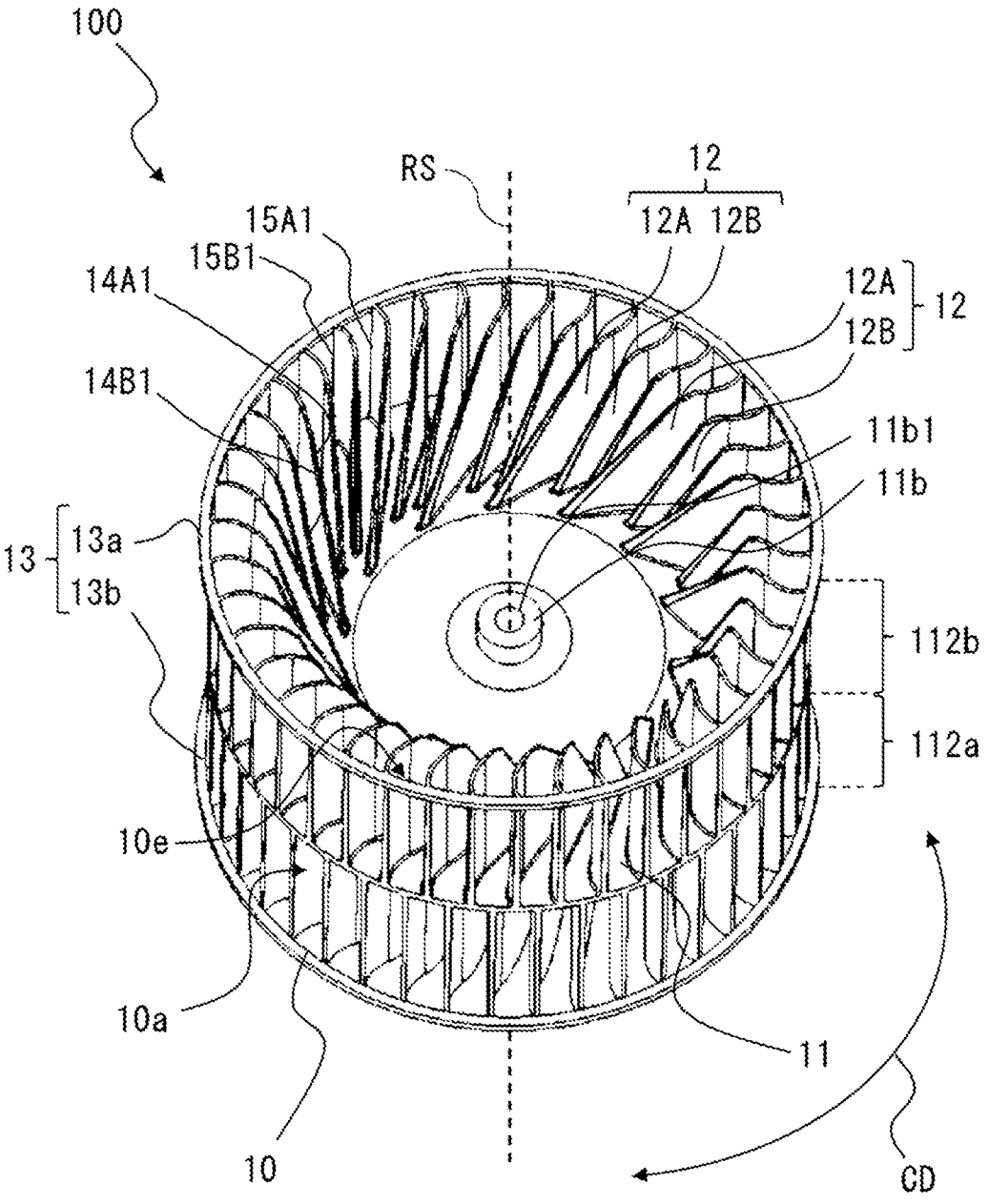
FIG. 5 is a perspective view of an opposite side of a side of the fan that is illustrated in FIG. 4.
Figure 6:
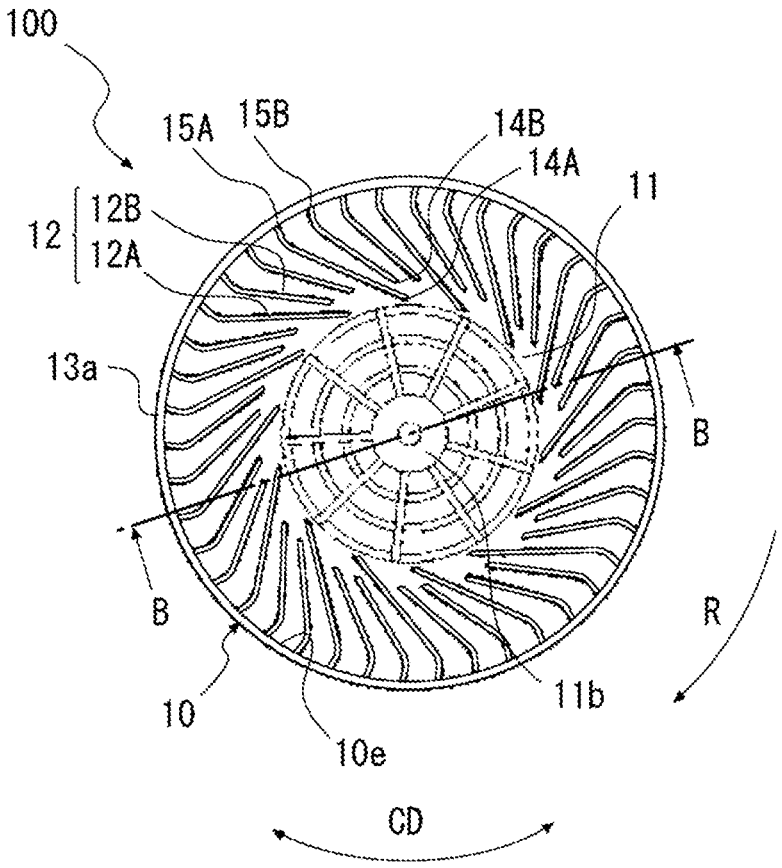
FIG. 6 is a plan view of part of the fan of the centrifugal air-sending device according to Embodiment 1 that is located on one side of a main plate.
Figure 7:
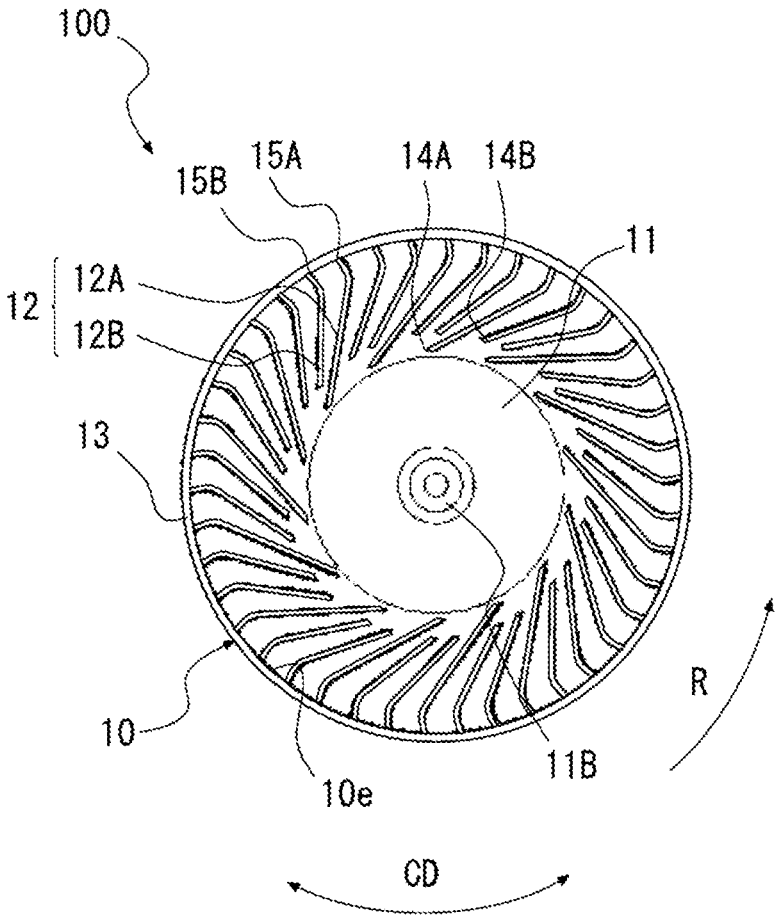
FIG. 7 is a plan view of part of the fan of the centrifugal air-sending device according to Embodiment 1 that is located on the other side of the main plate.
Figure 8:
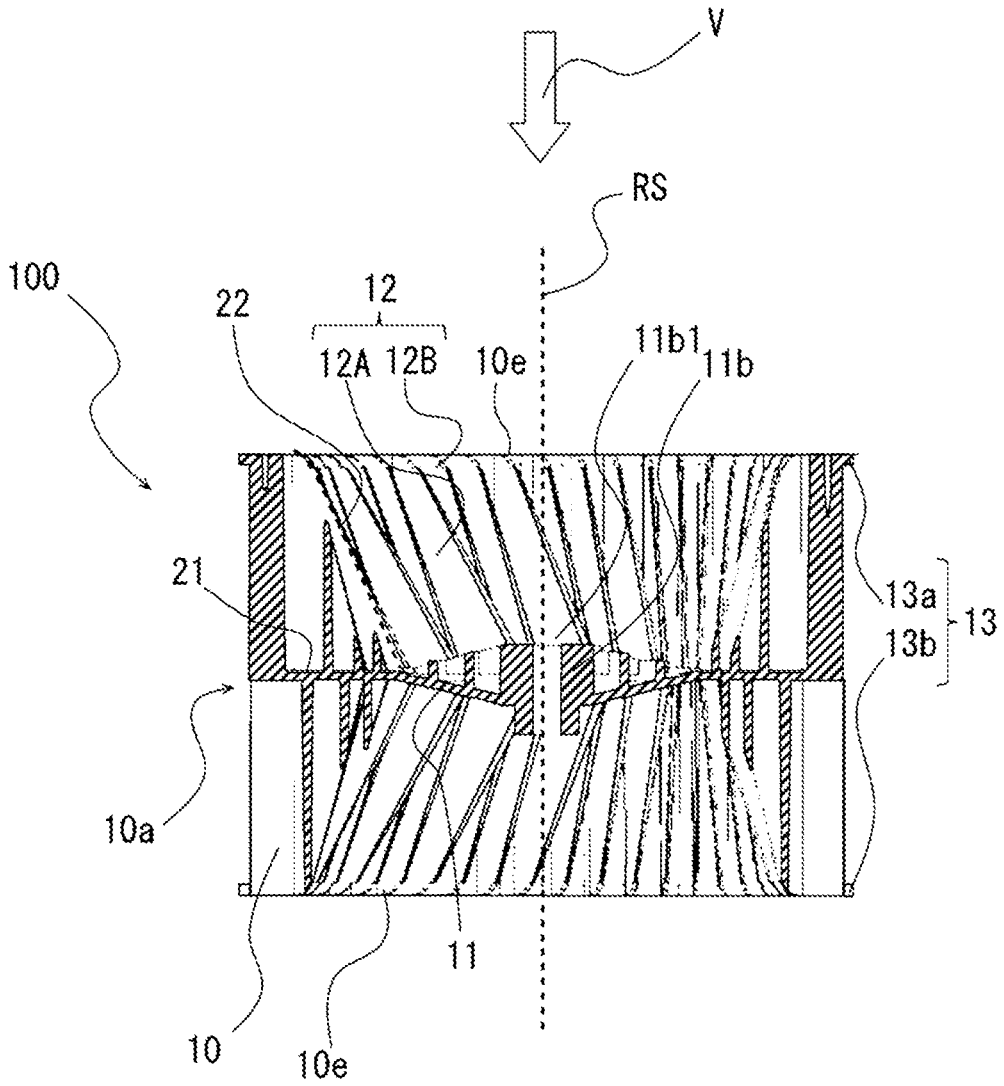
FIG. 8 is a sectional view of the fan that is taken along line B-B in FIG. 6.

FIG. 4 is a perspective view of the fan 10 included in the centrifugal air-sending device 100 according to Embodiment 1. FIG. 5 is a perspective view of the opposite side of a side of the fan 10 that is illustrated in FIG. 4. FIG. 6 is a plan view of part of the fan 10 of the centrifugal air-sending device 100 according to Embodiment 1 that is located on one side of the main plate 11. FIG. 7 is a plan view of part of the fan 10 of the centrifugal air-sending device 100 according to Embodiment 1 that is located on the other side of the main plate 11. FIG. 8 is a sectional view of the fan 10 that is taken along line B-B in FIG. 6. The fan 10 will be described with reference to FIGS. 4 to 8.

The fan 10 is a centrifugal fan. The fan 10 is connected to a motor (not illustrated) having a drive shaft. The fan 10 is driven to rotate, for example, by the motor, and is forcibly made to send air outward in the radial direction by a centrifugal force generated by the rotation of the fan 10. The fan 10 is rotated, for example, by the motor in the rotation direction R which is indicated by an arrow. As illustrated in FIG. 4, the fan 10 includes that main plate 11 which is formed to have a disk shape, annular side plates 13, and the plurality of blades 12 which are radially arranged around the rotation axis RS at a circumferential edge portion of the main plate 11.

(Main Plate 11)

Regarding the shape of the main plate 11, it suffices that the main plate 11 is formed in the shape of a plate. For example, the main plate 11 may be formed to have a polygonal shape or shapes other than a disk shape. Furthermore, the main plate 11 may be formed such that as illustrated in FIG. 3, the thickness of the main plate 11 increases toward the center thereof in the radial direction perpendicular to the rotation axis RS, or may be formed such that the thickness is uniform in the radial direction. Furthermore, the main plate 1 is not limited to a main plate including only one plate-like member, and may be a main plate in which a plurality of plate-like members are formed fixedly and integrally with each other.

The boss portion 11*b* is provided at a central portion of the main plate 11. To the boss portion 11*b*, the drive shaft of the motor is connected. The boss portion 11*b* has a shaft hole 11*b*1 into which the drive shaft of the motor is inserted. The main plate 11 is driven to rotate by the motor via the boss portion 11*b*.

(Side Plate 13)

The annular side plates 13 of the fan 10 are attached to ends of the plurality of blades 12 that are located opposite to the main plate 11 in the axial direction along the rotation axis RS of the boss portion 11*b*. The side plates 13 are provided at outer circumferential side surfaces 10*a* of the fan 10, and in the fan 10, the side plates 13 are provided opposite to the main plate 11. The side plates 13 are located outward of the blades 12 in the radial direction perpendicular to the rotation axis RS. The side plates 13 defines the suction ports 10*e* of the fan 10 through which air is sucked. The side plate 13 couples the plurality of blades 12 to each other, thereby maintaining a positional relationship between distal ends of the blades 12 and reinforcing the plurality of blades 12.

The side plates 13 are an annular first side plate 13*a* and an annular second side plate 13*b* that are located opposite to each other with respect to the main plate 1. It should be noted that the side plates 13 are generic terms for the first side plate 13*a* and the second side plate 13*b*, and the fan 10 includes the first side plate 13*a* and the second side plate 13*b* as the side plates 13 which are located opposite to each other with respect to the main plate 11 in the axial direction along the rotation axis RS.

(Blades 12)

As illustrated in FIG. 4, the plurality of blades 12 are arranged in a circumferential direction CD around an imaginary rotation axis of the main plate 11, that is, the rotation axis RS thereof; and one end of each of the plurality of blades 12 is connected to the main plate 11, and the other end of the blade 12 is connected to the side plate 13. Each of the plurality of blades 12 is provided between the main plate 11 and the side plate 13. The plurality of blades 12 are provided on both sides of the main plate 11 in the axial direction along the rotation axis RS of the boss portion 11*b*. At the circumferential edge portion of each of the both sides of the main plate 11, the blades 12 are arranged at regular intervals.

Figure 9:
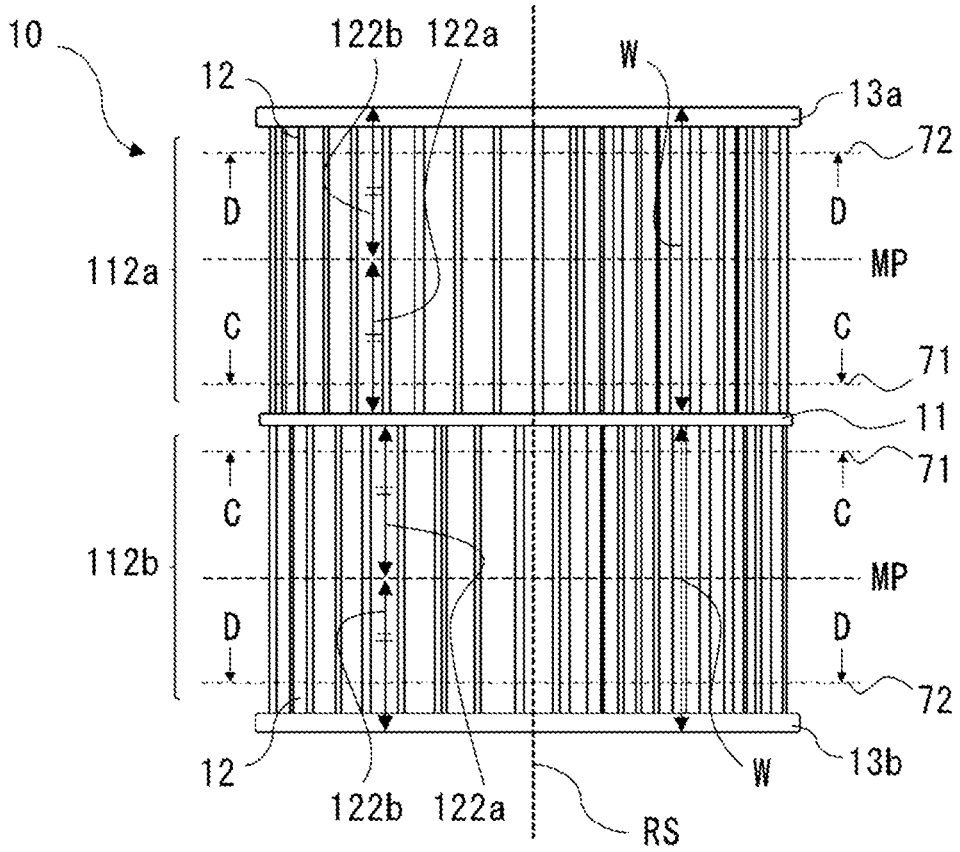
FIG. 9 is a side view of the fan as illustrated in FIG. 4.

FIG. 9 is a side view of the fan as illustrated in FIG. 4. As illustrated in FIGS. 4 and 9, the fan 10 has a first blade portion 112*a* and a second blade portion 112*b*. The first blade portion 112*a* and the second blade portion 112*b* each include a plurality of blades 12 and a side plate 13. More specifically, the first blade portion 112*a* includes the annular first side plate 13*a* and the blades 12 provided between the main plate 11 and the first side plate 13*a*. The second blade portion 112*b* includes the annular second side plate 13*b* and the blades 12 provided between the main plate 11 and the second side plate 13*b*.

The first blade portion 112*a* is provided on one plate side of the main plate 11, and the second blade portion 112*b* is provided on the other plate side of the main plate 11. The plurality of blades 12 are provided on both sides of the main plate 11 in the axial direction along the rotation axis RS, and the first blade portion 112*a* and the second blade portion 112*b* are located back to back, with the main plate 11 interposed between the first blade portion 112*a* and the second blade portion 112*b*. In the following description, the blades 12 included in the first blade portion 112*a* and the blades 12 included in the second blade portion 112*b* are collectively referred to as "blades 12" unless otherwise noted.

As illustrated in FIGS. 4 and 5, the plurality of blades 12 are arranged on the main plate 11 such that the fan 10 is formed in a tubular shape. Moreover, the fan 10 has the suction ports 10*e* which are formed on respective sides where the side plate 13 are located opposite to each other with respect to the main plate 11 in the axial direction along the rotation axis RS of the boss portion 11*b*, and through which air flows into spaces surrounded by the main plate 11 and the plurality of blades 12. The fan 10 includes the blades 12 and the side plates 13 on the both sides with reference to the main plate 11, and has the suction ports 10*e* on the both sides with reference to the main plate 11. It should be noted that in the case where the centrifugal air-sending device 100 is a single-suction centrifugal air-sending device 100, the fan 10 has a suction port 10*e* on one side with reference to the main plate 11.

The fan 10 is driven to rotate around the rotation axis RS by driving of the motor (not illustrated). When the fan 10 is rotated, air that flows outside the centrifugal air-sending device 100 is sucked into the spaces surrounded by the main plate 11 and the plurality of blades 12 through the suction ports 45 formed in the scroll casing 40 as illustrated in FIG. 1 and the suction port 10*e* of the fan 10. Then, when the fan 10 is rotated, air sucked in the spaces surrounded by the main plate 11 and the blades 12 is sent out outward in the radial direction of the fan 10 through the space between any adjacent two of the blades 12.

(Detailed Configuration of Blade 12)

Figure 10:
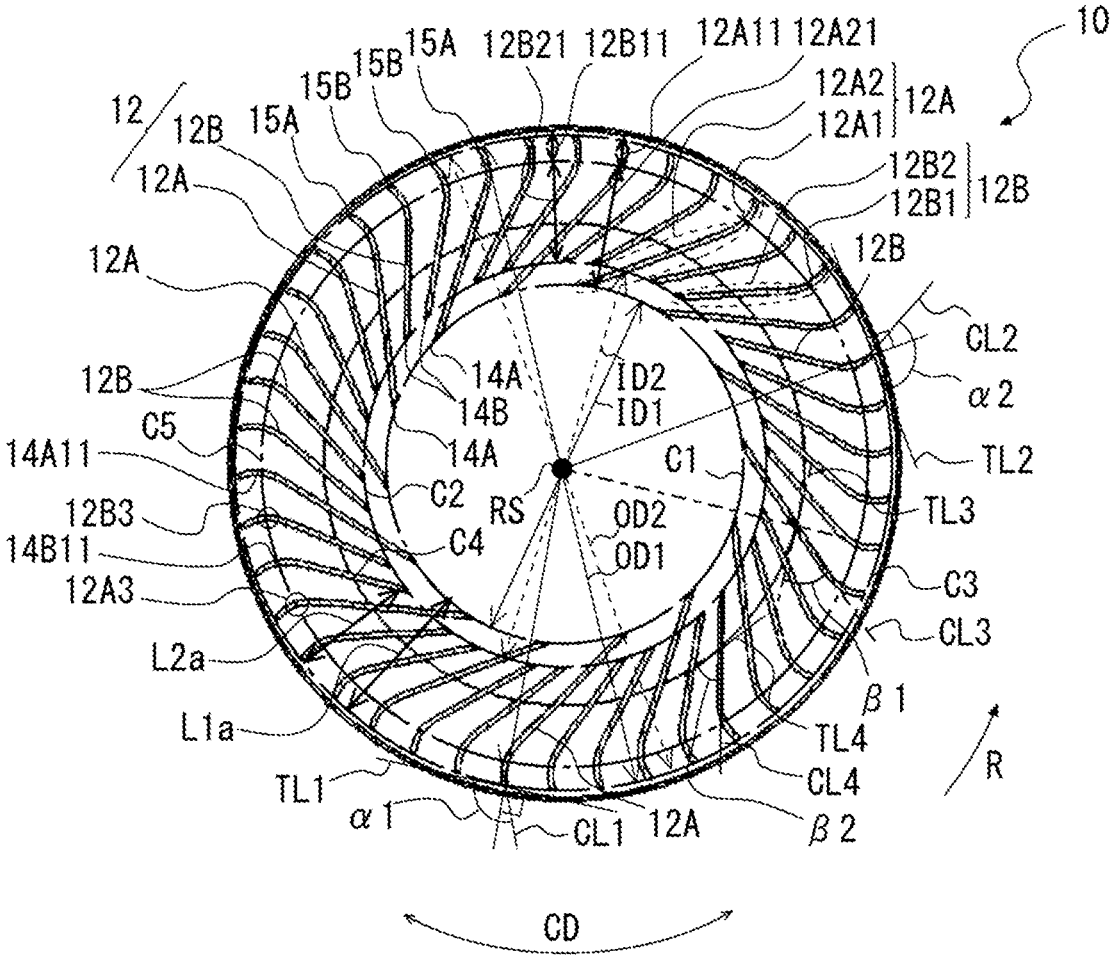
FIG. 10 is a schematic view of blades in a section of the fan that is taken along line C-C in FIG. 9.
Figure 11:
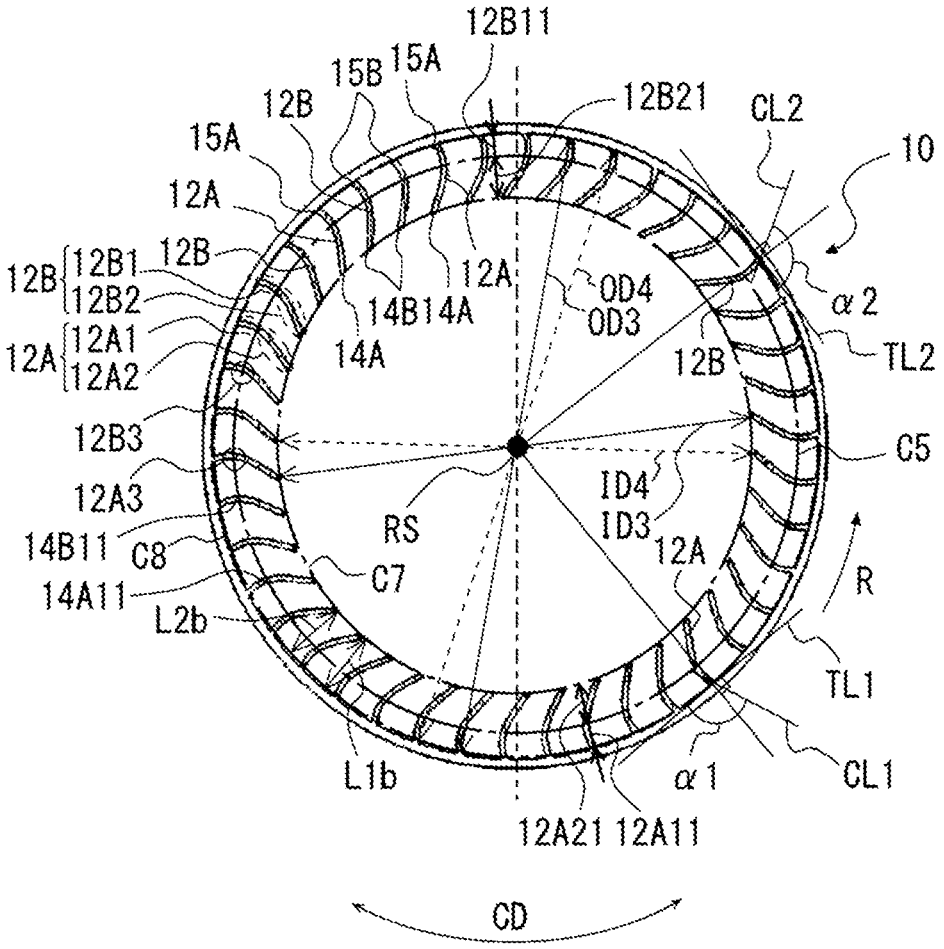
FIG. 11 is a schematic view of blades in a section of the fan that is taken along line D-D in FIG. 9.

FIG. 10 is a schematic view of blades 12 in a section of the fan 10 that is taken along line C-C in FIG. 9. FIG. 11 is a schematic view of blades 12 in a section of the fan that is taken along line D-D in FIG. 9. In FIG. 9 illustrating the fan 10, each of middle positions MP indicates a middle position between the main plate 11 and the side plate 13 in the axial direction along the rotation axis RS, in the plurality of blades 12 of each of the first blade portion 112*a* and the second blade portion 112*b*.

In each of the plurality of blades 12 of the first blade portion 112*a*, a region from the middle position MP in the axial direction along the rotation axis RS to the main plate 11 is a main-plate-side blade region 122*a* that is a first region in the fan 10; and a region from the middle position MP in the axial direction along the rotation axis RS to an end portion of the blade 12 that adjoins the side plate 13 is a side-plate-side blade region 122*b* that is a second region in the fan 10. That is, each of the plurality of blades 12 has the first region which is located closer to the main plate 11 than the middle position MP in the axial direction along the rotation axis RS and the second region which is located closer to the side plate 13 than the first region.

As illustrated in FIG. 10, the section taken along line C-C in FIG. 9 is a section of part of the plurality of blades 12 that is close to the main plate 11 of the fan 10, that is, that is located in the main-plate-side blade region 122*a* corresponding to the first region. The section of the part of the blades 12 that is close to the main plate 11 is a first plane 71 perpendicular to the rotation axis RS. Also, this section is a first section of the fan that is obtained by cutting the part of the fan 10 that is close to the main plate 11. It should be noted that the part of the fan 10 that is close to the main plate 11 is, for example, part of the fan 10 that is closer to the main plate 11 than the middle position of the main-plate-side blade region 122*a* in the axial direction along the rotation axis RS, or part of the fan 10 in which end portions of the blades 12 that are close to the main plate 11 are located in the axial direction along the rotation axis RS.

As illustrated in FIG. 11, the section taken along line D-D in FIG. 9 is a section of part of the plurality of blades 12 that is close to the side plate 13 of the fan 10, that is, that is located in the side-plate-side blade region 122*b* corresponding to the second region. The section of the part of the blades 12 that is close to the side plate 13 is a second plane 72 perpendicular to the rotation axis RS. Also, this section is a second section of the fan 10 that is obtained by cutting part of the fan 10 that is close to the side plate 13. It should be noted that the part of the fan 10 that is close to the side plate 13 is, for example, part of the fan 10 that is closer to the side plate 13 than the middle position of the side-plate-side blade region 122*b* in the axial direction along the rotation axis RS, or part of the fan 10 in which end portions of the blades 12 that are close to the side plate 13 are located in the axial direction along the rotation axis RS.

A basic configuration of the blades 12 in the second blade portion 112*b* is the same as a basic configuration of the blades 12 in the first blade portion 112*a*. That is, in each of the plurality of blades 12 of the second blade portion 112*b*, a region from the middle position MP in the axial direction along the rotation axis RS to the main plate 11 is a main-plate-side blade region 122*a* that is a first region in the fan 10; and a region from the middle position MP in the axial direction along the rotation axis RS to an end portion of the blade 12 that adjoins the second side plate 13*b* is a side-plate-side blade region 122*b* that is a second region in the fan 10.

Although it is described above that the configuration of the first blade portion 112*a* and that of the second blade portion 112*b* are the same as each other, the configuration of the fan 10 is not limited to such a configuration. The first blade portion 112*a* and the second blade portion 112*b* may have different configurations. That is, the configuration of the blades 12 that will be described below may be applied to the blades included in both or one the first blade portion 112*a* and the second blade portion 112*b*.

As illustrated in FIGS. 9 to 11, the plurality of blades 12 include a plurality of first blades 12A and a plurality of second blades 12B. In the plurality of blades 12, the first blades A and the second blades 12B are alternately arranged in the circumferential direction CD of the fan 10 such that as any adjacent ones of the blades 12, one first blade 12A and one or more second blades 12B are adjacent.

As illustrated in FIGS. 9 to 11, the plurality of first blades 12A and the plurality of second blades 12B are arranged in the circumferential direction CD such that at least one first blade 12B is located between any adjacent two first blades 12A. It should be noted that the configuration of the fan 10 is not limited to the above configuration, and the fan 10 may be formed to include either the first blades 12A or the second blades 12B.

As illustrated in FIG. 10, each of the first blades 12A has an inner circumferential end 14A and an outer circumferential end 15A in the first section of the fan 10 which is taken along the first plane 71 perpendicular to the rotation axis RS. The inner circumferential end 14A is located closer to the rotation axis RS in the radial direction perpendicular to the rotation axis RS, and the outer circumferential end 15A is located closer to an outer circumference than the inner circumferential end 14A in the radial direction. In first blade 12A, the inner circumferential end 14A is provided more forward than the outer circumferential end 15A in the rotation direction R of the fan 10.

As illustrated in FIG. 4, the inner circumferential end 14A is a leading edge 14A1 of the first blade 12A, and the outer circumferential end 15A is a trailing edge 15A1 of the first blade 12A. As illustrated in FIG. 11, the fan 10 has fourteen first blades 12A. However, the number of first blades 12A is not limited to 14 but may be smaller or larger than 14.

As illustrated in FIG. 10, each of the second blades 12B has an inner circumferential end 14B and an outer circumferential end 15B in the first section of the fan 10 which is taken along the first plane 71 perpendicular to the rotation axis RS. The inner circumferential end 14B is located closer to the rotation axis RS in the radial direction perpendicular to the rotation axis RS, and the outer circumferential end 15B is located closer to the outer circumference than the inner circumferential end 14B in the radial direction. In the second blade 12B, the inner circumferential end 14B is located more forward than the outer circumferential end 15B in the rotation direction R of the fan 10.

As illustrated in FIG. 4, the inner circumferential end 14B is a leading edge 14B1 of the second blade 12B, and the outer circumferential end 15B is a trailing edge 15B1 of the second blade 12B. As illustrated in FIG. 10, the fan 10 has twenty-eight second blades 12B. However, the number of second blades 12B is not limited to 28 but may be smaller or larger than 28.

A relationship between the first blade 12A and the second blade 12B will be described. As illustrated in FIGS. 4 and 11, in the range from the middle positions MP to the first side plate 13*a* or the second side plate 13*b* in the direction along the rotation axis RS, the smaller the distance between each of the first blade 12A and the second blade 12B and the first side plate 13*a* or the second side plate 13*b*, the smaller the difference between the blade length of the first blade 12A and the blade length of the second blade 12B.

As illustrated in FIGS. 4 and 10, the blade length of part of the first blade 12A that is closer to the main plate 11 than the middle position MP in the direction along the rotation axis RS is greater than the blade length of part of the second blade 12B that is closer to the main plate 11 than the middle position MP, and the smaller the distance between the above part of the first blade 12A and the main plate 11, the greater the blade length of the part of the first blade 12A. In such a manner, in Embodiment 1, in the direction along the rotational axis RX, the blade length of at least part of the first blade 12A is greater than the blade length of the second blade 12B. It should be noted that the term "blade length" means the length of the first blade 12A in the radial direction of the fan 10 and the length of the second blade 12B in the radial direction of the fan 10.

It is assumed that as illustrated in FIG. 10, in the first section closer to the main plate 11 than the middle position MP as illustrated in FIG. 9, the diameter of a circle C1 passing through the inner circumferential ends 14*a* of the plurality of first blades 12A around the rotation axis RS is an inside diameter ID1, that is, the inside diameter of the first blades 12A. Also, it is assumed that the diameter of a circle C3 passing through the outer circumferential ends 15A of the plurality of first blades 12A around the rotation axis RS is an outside diameter OD1, that is, the outside diameter of the first blades 12A. One-half of the difference between the outside diameter OD1 and the inside diameter ID1 is equal to the blade length L1*a* of each of the first blades 12A in the first section (blade length L1*a*=(outside diameter OD1−inside diameter ID1)/2).

It should be noted that in a common centrifugal air-sending device, the blade length of a blade in a section perpendicular to the rotation axis is smaller than the width of the blade in a direction parallel to the rotation axis. Also, in Embodiment 1, the maximum blade length of the first blade 12A, that is, the blade length of an end portion of the first blade 12A that adjoins the main plate 11 is smaller than the width W (see FIG. 9) of the first blade 12A in the direction parallel to the rotation axis.

Furthermore, it is assumed that in the first section, the diameter of a circle C2 passing through the inner circumferential ends 14B of the plurality of second blades 12B around the rotation axis RS is an inside diameter ID2, that is, the inside diameter of the second blades 12B. The inside diameter ID 2 is larger than the inside diameter ID1 (inside diameter ID2>inside diameter ID1). Also, it is assumed that the diameter of the circle C3 passing through the outer circumferential ends 15B of the plurality of second blades 12B around the rotation axis RS is an outside diameter OD2, that is, the outside diameter of the second blades 12B. The outside diameter OD2 is equal to the outside diameter OD1 (outside diameter OD2=outside diameter OD1). One-half of the difference between the outside diameter OD2 and the inside diameter ID2 is equal to the blade length L2*a* of the second blade 12B in the first section (blade length L2*a*=(outside diameter OD2−inside diameter ID2)/2). The blade length L2*a* of the second blade 12B in the first section is smaller than the blade length L1*a* of the first blade 12A in the first section (blade length L2*a*<blade length L1*a*).

Moreover, it is assumed that as illustrated in FIG. 11, in the second section closer to the side plate 13 than the middle position MP as indicated in FIG. 9, the diameter of a circle C7 passing through the inner circumferential ends 14A of the first blades 12A around the rotation axis RS is an inside diameter ID3. The inside diameter ID3 is larger than the inside diameter ID1 of the first section (inside diameter ID3>inside diameter ID1). Also, it is assumed that the diameter of a circle C8 passing through the outer circumferential ends 15A of the first blades 12A around the rotation axis RS is an outside diameter OD3. One-half of the difference between the outside diameter OD3 and the inside diameter ID1 is equal to the blade length L1*b* of the first blade 12A in the second section (blade length L1*b*=(outside diameter OD3−inside diameter ID3)/2).

Furthermore, it is assumed that in the second section, the diameter of the circle C7 passing through the inner circumferential ends 14B of the second blades 12B around the rotation axis RS is an inside diameter ID4. The inside diameter ID4 is equal to the inside diameter ID3 (inside diameter ID4=inside diameter ID3). It is assumed that the diameter of the circle C8 passing through the outer circumferential ends 15B of the second blades 12B around the rotation axis RS is an outside diameter OD4. The outside diameter OD4 is equal to the outside diameter OD3 (outside diameter OD4=outside diameter OD3). One-half of the difference between the outside diameter OD4 and the inside diameter ID4 is equal to the blade length L2*b* of each of the second blades 12B in the second section (blade length L2*b*=(outside diameter OD4−inside diameter ID4)/2). The blade length L2*b* of each of the second blades 12B in the second section is equal to the blade length L1*b* of each of the first blades 12A (blade length L2*b*=blade length L1*b*).

As viewed in a direction parallel to the rotation axis RS, the first blades 12A in the second section as illustrated in FIG. 11 are located within regions defined by the contours of the first blades 12A in the first section as illustrated in FIG. 10 so as not to lie off the regions defined by the contours of the first blades 12A. Thus, the fan 10 satisfies the relationships "outside diameter OD3=outside diameter OD1", "inside diameter ID3 inside diameter ID1", and "blade length L1*b* blade length L1*a*".

Similarly, as viewed in the direction parallel to the rotation axis RS, the second blades 12B in the second section as illustrated in FIG. 11 is located within the counters of the second blades 12B in the first section as illustrated in FIG. 10 so as not to lie off the contours of the second blades 12B. Thus, the fan 10 satisfies the relationships "outside diameter OD4=outside diameter OD2", "inside diameter ID4 inside diameter ID2", and "blade length L2*b* blade length L2*a*".

Since the blades 12 are formed such that the inside diameter ID3 the inside diameter ID1, the inside diameter ID4 the inside diameter ID2, and the inside diameter ID2>the inside diameter ID1, the inside diameter of the first blades 12A can be set as the blade inside diameter of the blades 12. Furthermore, since the blades 12 are formed such that the outside diameter OD3=the outside diameter OD1, the outside diameter OD4=the outside diameter OD2, and the outside diameter OD2=the outside diameter OD1, the outside diameter of the first blades 12A can be set as the blade outside diameter of the blades 12.

It should be noted that the blade inside diameter of the plurality of blades 12 is the diameter of a circle passing through the inner circumferential ends of the plurality of blades 12. That is, the blade inside diameter of the plurality of blades 12 is the diameter of a circle passing through the leading edges 14A1 of the plurality of blades 12. Furthermore, the blade outside diameter of the plurality of blades 12 is the diameter of a circle passing through the outer circumferential ends of the plurality of blade 12. That is, the blade outside diameter of the plurality of blades 12 is the diameter of a circle passing through the trailing edges 15A1 and 15B1 of the plurality of blades 12.

(Configuration of First Blade 12A and Second Blade 12B)

In the comparison between the first section as illustrated in FIG. 10 and the second section as illustrated in FIG. 11, each of the first blades 12A satisfies the relationship "blade length L1*a*>blade length L1*b*". That is, each of the plurality of blades 12 has a portion that is formed such that the blade length in the first region is greater than the blade length in the second region. More specifically, the first blade 12A is formed such that its blade length decreases from a main plate side where the main plate 11 is located toward a side plate side where the side plate 13 is located, in the axial direction along the rotation axis RS.

Similarly, in the comparison between the first section as illustrated in FIG. 10 and the second section as illustrated in FIG. 11, each of the second blades 12B satisfies the relationship "blade length L2*a*>blade length L2*b*". That is, the second blade 12B has a portion that is formed such that the blade length decreases from the main plate side toward the side plate side in the axial direction along the rotation axis RS.

As illustrated in FIG. 3, the leading edges of the first blades 12A and the second blades 12B are inclined such that the blade inside diameter increases from the main plate side toward the side plate side. To be more specific, the plurality of blades include: blades 12 each having an inclined portion 141A that is inclined such that from the main plate side toward the side plate side, the blade inside diameter increases and the inner circumferential ends 14A included in the leading edges 14A1 extend in a direction away from the rotation axis RS; and blades 12 each having an inclined portion 141B that is inclined such that from the main plate side toward the side plate side, the blade diameter increases, and the inner circumferential ends 14B included in the leading edges 14B1 extend in the direction away from the rotation axis RS.

It should be noted that the configuration of each of the first blade 12A and the second blade 12B is not limited to the above configuration. For example, the first blade 12A and the second blade 12B may be formed such that the leading edge 14A1 and the leading edge 14B1 are parallel to the rotation axis RS. That is, the first blade 12A and the second blade 12B may be formed such that their blade lengths are constant from the main plate side to the side plate side. Each of the plurality of blades 12 may be formed such that the blade length in the first region is equal to the blade length in the second region, or may be formed such that the blade inside diameter is constant from the main plate side to the side plate side.

(Sirocco Blade Portion and Turbo Blade Portion)

As illustrated in FIGS. 10 and 11, each of the first blades 12A has a first sirocco blade portion 12A1 that includes an outer circumferential end 15A and that is formed as a forward-swept blade portion and a first turbo blade portion 12A2 that includes an inner circumferential end 14A and that is formed as a backward-swept blade portion. In the radial direction of the fan 10, the first sirocco blade portions 12A1 form the outer circumference of the first blade 12A, and the first turbo blade portions 12A2 form the inner circumference of the first blade 12A. That is, the first blade 12A is formed such that the first turbo blade portion 12A2 and the first sirocco blade portion 12A1 are arranged in this order from the rotation axis RS toward the outer circumference in the radial direction of the fan 10.

In each of the first blades 12A, the first turbo blade portion 12A2 and the first sirocco blade portion 12A1 are formed integrally with each other. The first turbo blade portion 12A2 forms the leading edge 14A1 of the first blade 12A, and the first sirocco blade portion 12A1 forms the trailing edge 15A1 of the first blade 12A. In the radial direction of the fan 10, the first turbo blade portion 12A2 linearly extends from the inner circumferential end 14A forming the leading edge 14A1 toward the outer circumference.

In the radial direction of the fan 10, in each of the first blades 12A, a region forming the first sirocco blade portion 12A1 will be referred to as a first sirocco region 12A11, and a region forming the first turbo blade portion 12A2 will be referred to as a first turbo region 12A21.

In the fan 10, in the main-plate-side blade region 122*a* which is the first region and the side-plate-side blade region 122*b* which is the second region as illustrated in FIG. 9, the area of the first sirocco region 12A11 is smaller than the area of the first turbo region 12A21 in the radial direction of the fan 10. In the fan 10 and each of the first blades 12A, in the main-plate-side blade region 122*a* and the side-plate-side blade region 122*b*, the area of the first turbo blade portion 12A2 is larger than the area of the first sirocco blade portion 12A1 in the radial direction of the fan 10.

Similarly, as illustrated in FIGS. 10 and 11, each of the second blades 12B has a second sirocco blade portion 12B1 that includes an outer circumferential end 15B and is formed as a forward-swept blade portion and a second turbo blade portion 12B2 that includes an inner circumferential end 14B and is formed as a backward-swept blade portion. In the radial direction of the fan 10, the second sirocco blade portion 12B1 forms the outer circumference of the second blade 12B, and the second turbo blade portion 12B2 forms the inner circumference of the second blade 12B. That is, the second blade 12B is formed such that the second turbo blade portion 12B2 and the second sirocco blade portion 1261 are arranged in this order from the rotation axis RS toward the outer circumference in the radial direction of the fan 10.

In each of the second blades 12B, the second turbo blade portion 12B2 and the second sirocco blade portion 1261 are formed integrally with each other. The second turbo blade portion 12B2 forms the leading edge 14B1 of the second blade 12B, and the second sirocco blade portion 1261 forms the trailing edge 15B1 of the second blade 12B. In the radial direction of the fan 10, the second turbo blade portion 12B2 linearly extends from the inner circumferential end 14B forming the leading edge 14B1 toward the outer circumference.

It should be note that an inner circumferential end portion of the first sirocco blade portion 12A1 will be referred to as a first sirocco leading edge 14A11, and an inner circumferential end portion of the second sirocco blade portion 1261 will be referred to as a second sirocco leading edge 14B11. The first sirocco leading edge 14A11 and the second sirocco leading edge 14B11 are edge portions of the sirocco blade portions, and form boundary portions between the sirocco blade portions and radial blade portions. In the case where the blade 12 has no radial blade portion, the first sirocco leading edge 14A11 forms a boundary portion between the first sirocco blade portion 12A1 and the first turbo blade portion 12A2; and the second sirocco leading edge 14611 forms a boundary portion between the second sirocco blade portion 1261 and the second turbo blade portion 12B2.

In the radial direction of the fan 10, in each of the second blades 12B, a region forming the second sirocco blade portion 1261 will be referred to as a second sirocco region 12B11, and a region forming the second turbo blade portion 12B2 will be referred to as a second turbo region 12B21.

In the fan 10, in the main-plate-side blade region 122*a* which is as the first region and the side-plate-side blade region 122*b* which is the second region as illustrated in FIG. 9, the area of the second sirocco region 12B11 is smaller than the area of the second turbo region 12B21 in the radial direction of the fan 10. In the fan 10 and each of the second blades 12B, in the main-plate-side blade region 122*a* the side-plate-side blade region 122*b*, the area of the second turbo blade portion 12B2 is larger than the area of the second sirocco blade portion 1261 in the radial direction of the fan 10.

Each of the plurality of blades 12 is formed such that in the first region and the second region, the area of the turbo blade portion in the radial direction is larger than the area of the sirocco blade portion in the radial direction. The relationship between the area of the sirocco blade portion and the area of the turbo blade portion in the radial direction of the rotation axis RS may be established in both the main-plate-side blade region 122*a* which is the first region and the side-plate-side blade region 122*b* which is the second region. It should be noted that the configuration of the plurality of blades 12 is not limited to the above configuration. In the first region and the second region, the area of the turbo blade portion in the radial direction is smaller than or equal to the area of the sirocco blade portion in the radial direction.

(Blade Outlet Angle)

It is assumed that as illustrated in FIG. 10, a blade outlet angle of the first sirocco blade portion 12A1 of the first blade 12A in the first section is a blade outlet angle α1. The blade outlet angle α1 is an angle between a tangent line TL1 and a center line CL1 of the first sirocco blade portion 12A1 at the outer circumferential end 15A at an intersection of the circle C3 around the rotation axis RS and the outer circumferential end 15A. This blade outlet angle α1 is greater than 90 degrees.

The blade outlet angle of the second sirocco blade portion 1261 of each of the second blades 12B in the first section is a blade outlet angle α2. The blade outlet angle α2 is an angle between a tangent line TL2 and a center line CL2 of the second sirocco blade portion 12B1 at the outer circumferential end 15B at an intersection of the circle C3 around the rotation axis RS and the outer circumferential end 15B. The blade outlet angle α2 is greater than 90 degrees.

The blade outlet angle α2 of the second sirocco blade portion 12B1 is equal to the blade outlet angle α1 of the first sirocco blade portion 12A1 (blade outlet angle α2=blade outlet angle α1). The first sirocco blade portion 12A1 and the second sirocco blade portion 12B1 are each formed in an arc in such a manner as to curve in the opposite direction to the rotation direction R as viewed in the direction parallel to the rotation axis RS.

As illustrated in FIG. 11, in the fan 10, also in the second section, the blade outlet angle α1 of the first sirocco blade portion 12A1 and the blade outlet angle α2 of the second sirocco blade portion 12B1 are equal to each other. That is, each of the plurality of blades 12 has a sirocco blade portion that is formed as a forward-swept blade portion having a blade outlet angle of greater than 90 degrees, in a range from the main plate 11 to the side plate 13.

Furthermore, as illustrated in FIG. 10, the blade outlet angle of the first turbo blade portion 12A2 of the first blade 12A in the first section is a blade outlet angle β1. The blade outlet angle β1 is an angle between a tangent line TL3 and a center line CL3 of the first turbo blade portion 12A2 at an intersection of a circle C4 around the rotation axis RS and the first turbo blade portion 12A2. This blade outlet angle β1 is smaller than 90 degrees.

Furthermore, the blade outlet angle of the second turbo blade portion 12B2 of the second blades 12B in the first section is a blade outlet angle β2. The blade outlet angle β2 is an angle between a tangent line TL4 and a center line CL4 of the second turbo blade portion 12B2 at an intersection of the circle C4 around the rotation axis RS and the second turbo blade portion 12B2. The blade outlet angle β2 is smaller than 90 degrees.

The blade outlet angle β2 of the second turbo blade portion 12B2 is equal to the blade outlet angle β1 of the first turbo blade portion 12A2 (blade outlet angle β2=blade outlet angle β1).

In the fan 10, also in the second section, the blade outlet angle β1 of the first turbo blade portion 12A2 and the blade outlet angle β2 of the second turbo blade portion 12B2 are equal to each other, though this illustration is omitted in FIG. 11. Furthermore, the blade outlet angle β1 and the blade outlet angle β2 are smaller than 90 degrees.

(Radial Blade Portion)

As illustrated in FIGS. 10 and 11, each of the first blades 12A has a first radial blade portion 12A3 that is a connection portion between the first turbo blade portion 12A2 and the first sirocco blade portion 12A1. The first radial blade portion 12A3 is a formed as a radial blade portion linearly extending in the radial direction of the fan 10.

Similarly, each of the second blades 12B has a second radial blade portion 1263 that is formed as a connection portion between the second turbo blade portion 12B2 and the second sirocco blade portion 1261. The second radial blade portion 1263 is formed as a radial blade portion linearly extending in the radial direction of the fan 10.

The first radial blade portion 12A3 and the second radial blade portion 1263 each have a blade angle of 90 degrees. More specifically, the angle between a center line of the first radial blade portion 12A3 and a tangent line at an intersection of the center line of the first radial blade portion 12A3 and a circle C5 around the rotation axis RS is 90 degrees. Furthermore, the angle between a center line of the second radial blade portion 12B3 and a tangent line at an intersection of the center line of the second radial blade portion 12B3 and the circle C5 around the rotation axis RS is 90 degrees.

(Inter-Blade Distance)

The distance between any adjacent two of the plurality of blades 12 in the circumferential direction CD will be referred to as an inter-blade distance. The inter-blade distance increases from a leading edge side where the leading edge 14A1 or the leading edge 14B1 is located toward a trailing edge side where the trailing edge 15A1 or the trailing edge 15B1 is located, as illustrated in FIGS. 10 and 11.

Specifically, the inter-blade distance between turbo blade portions that are the first turbo blade portion 12A2 and the second turbo blade portion 12B2 increases from the inner circumference side toward the outer circumference side. That is, in the fan 10, the inter-blade distance between the turbo blade portions increases from the inner circumference side toward the outer circumference side. Furthermore, the inter-blade distance between sirocco blade portions that are the first sirocco blade portion 12A1 and the second sirocco blade portion 12B1 is greater than the inter-blade distance between the turbo blade portions, and increases from the inner circumference side toward the outer circumference side.

In other words, the inter-blade distance between the first turbo blade portion 12A2 and a second turbo blade portion 12B2 or the inter-blade distance between adjacent second turbo blade portions 12β2 increases from the inner circumference side toward the outer circumference side. Furthermore, the inter-blade distance between the first sirocco blade portion 12A1 and the second sirocco blade portion 12B1 or the inter-blade distance between adjacent second sirocco blade portions 12B1 is greater than the inter-blade distance between the turbo blade portions, and increases from the inner circumference side toward the outer circumference side.

[Operation of Centrifugal Air-Sending Device 100]

An operation of the centrifugal air-sending device will be described with reference to FIG. 1. In the centrifugal air-sending device 100, when the motor (not illustrated) is driven, the main plate 11 to which a motor shaft is connected is rotated, and the plurality of blades 12 are rotated around the rotation axis RS via the main plate 11. As a result, in the centrifugal air-sending device 100, air is sucked from the outside of the scroll casing 40 into the fan 10 through the suction port 45, and is then blown from the fan 10 into the scroll casing 40 by a pressure-raising action of the fan 10. The air blown from the fan 10 into the scroll casing 40 is reduced in velocity through an expanded air passage defined by the circumferential wall 44*c* of the scroll casing 40 to recover its static pressure, and is blown from the discharge port 42*a* as illustrated in FIG. 1 to the outside.

[Air-Conditioning Apparatus 140]

Figure 12:
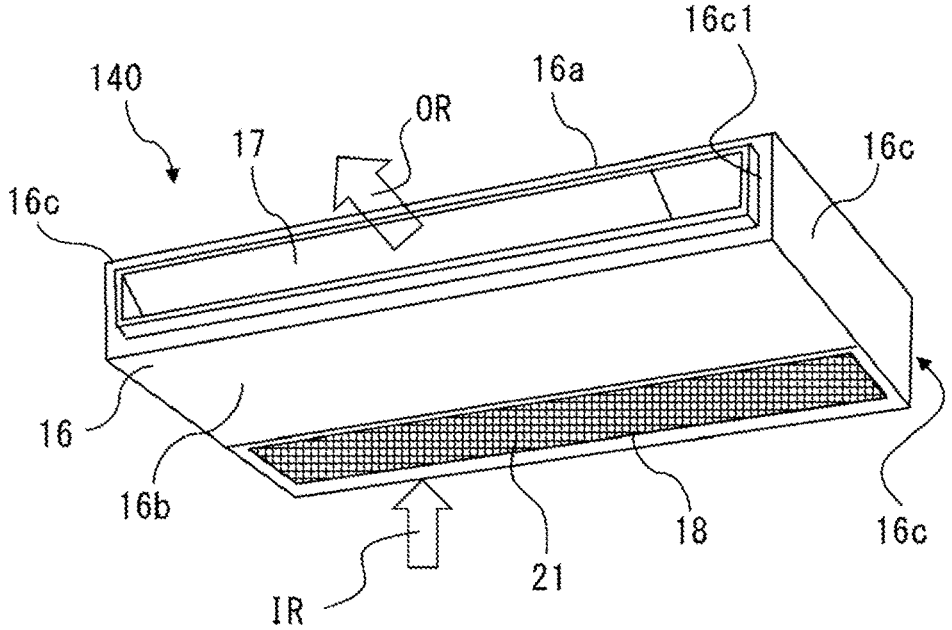
FIG. 12 is a perspective view illustrating an example of an air-conditioning apparatus according to Embodiment 1.
Figure 13:
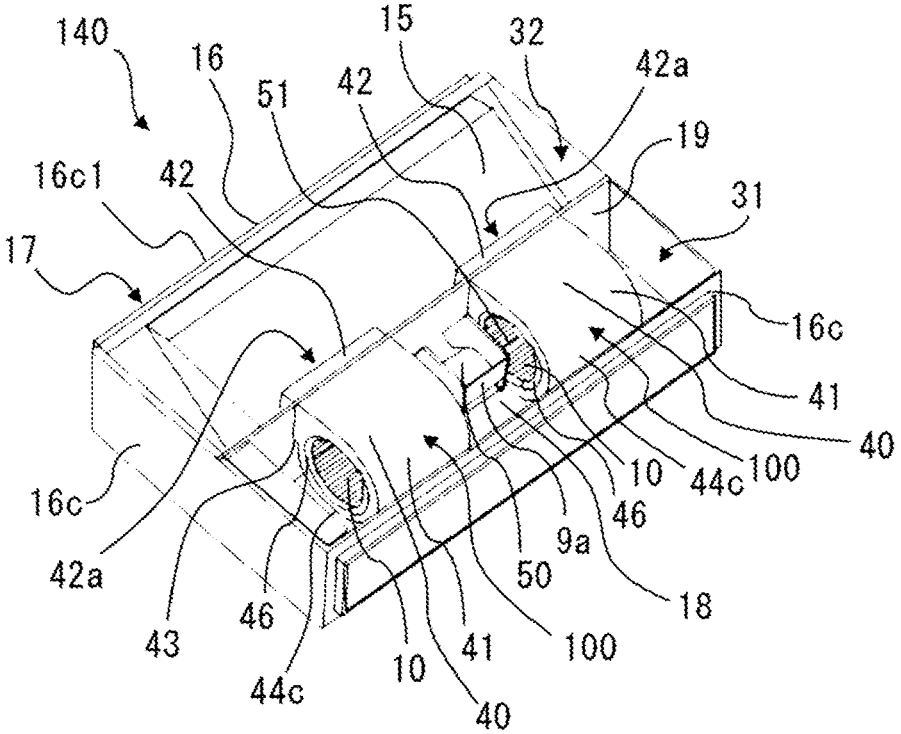
FIG. 13 is a perspective view illustrating an example of an internal configuration of the air-conditioning apparatus according to Embodiment 1.

FIG. 12 is a perspective view illustrating an example of an air-conditioning apparatus 140 according to Embodiment 1. FIG. 13 is a perspective view illustrating an example of an internal configuration of the air-conditioning apparatus 140 according to Embodiment 1. It should be noted that in FIG. 13, illustration of an upper surface portion 16*a* is omitted in order to illustrate the internal configuration of the air-conditioning apparatus 140. The air-conditioning apparatus 140 includes the centrifugal air-sending device 100, and will be described with reference to FIGS. 12 and 13.

The air-conditioning apparatus 140 air-conditions an air-conditioning target space. The air-conditioning apparatus 140 adjusts the temperature and humidity of sucked air, and sends the air to the air-conditioning target space. Although the air-conditioning apparatus 140 is a ceiling-suspended apparatus suspended from a ceiling, the air-conditioning apparatus 140 is not limited to the ceiling-suspended apparatus.

The air-conditioning apparatus 140 includes the centrifugal air-sending device 100, a driving source 50 that gives a driving force to the fan 10 of the centrifugal air-sending device 100, and a heat exchanger 15 that is provided at such a position as to face a discharge port 42*a* for air that is formed in the scroll casing 40 of the centrifugal air-sending device 100. Furthermore, the air-conditioning apparatus 140 includes a housing 16 that houses the centrifugal air-sending device 100, the driving source 50, and the heat exchanger 15 and that is provided in the air-conditioning target space. It should be noted that regarding the location of the heat exchanger 15, it suffices that the heat exchanger 15 is located between the centrifugal air-sending device 100 and a housing air outlet 17 in an air passage in the housing 16 through which air sent from the centrifugal air-sending device 100 flows. It is not indispensable that the heat exchanger 15 is located to face the discharge port 42*a*.

(Housing 16)

As illustrated in FIG. 12, the housing 16 is formed of decorative panels and formed in the shape of a box. To be more specific, the housing 16 is formed in the shape of a cuboid having an upper surface portion 16*a*, a lower surface portion 16*b*, and side surface portions 16*c*. It should be noted that the shape of the housing 16 is not limited to a cuboid shape but may be another shape such as a cylindrical shape, a prismatic shape, a conical shape, a shape having a plurality of corner portions, or a shape having a plurality of curved surface portions. The upper surface portion 16*a*, the lower surface portion 16*b*, and the side surface portions 16*c* are wall portions of the housing 16, and are decorative panels. In the case where the air-conditioning apparatus 140 is a ceiling-suspended apparatus, the housing 16 is installed on a ceiling.

The housing 16 has a housing suction port 18 that is formed in the lower surface portion 16*b*. At the housing suction port 18, a filter 21 is provided to remove dirt and dust from air. The filter 21 is fixedly attached to the decorative panel forming the lower surface portion 16*b* and covers the housing suction port 18. Furthermore, the housing 16 has, as one of the side surface portions 16*c*, an outlet wall portion 16*c*1 having a housing air outlet 17.

An arrow IR as illustrated in FIG. 12 indicates air that is sucked through the housing suction port 18. The housing suction port 18 of the housing 16 is an opening port through which air to be sucked into the centrifugal air-sending device 100 flows into the housing 16 in the case where the fan 10 of the centrifugal air-sending device 100 is driven to rotate by the driving source 50. The housing air outlet 17 of the housing 16 is an opening port through which air that is sent from the centrifugal air-sending device 100 and passes through the heat exchanger 15 flows out from a heat exchange chamber 32, which will be described later. An arrow OR as illustrated in FIG. 12 indicates air that is blown out from the housing air outlet 17.

The housing air outlet 17 and the housing suction port 18 are each formed to have a rectangular shape as illustrated in FIG. 12. It should be noted that the shapes of the housing air outlet 17 and the housing suction port 18 are not limited to rectangular shapes, buy may be other shapes such as circular shapes or oval shapes.

The housing 16 has an internal space that is partitioned by a partition plate 19 into an air-sending chamber 31 and the heat exchange chamber 32, and the air-sending chamber 31 is located on an air-suction side of the scroll casing 40 and the heat exchange chamber 32 is located on an air-blowing side of the scroll casing 40. That is, the partition plate 19 partitions the internal space of the housing 16 into the air-sending chamber 31 in which the fan 10 is located and the heat exchange chamber 32 in which the heat exchanger 15 is located.

As illustrated in FIG. 13, in the centrifugal air-sending device 100, the scroll casing 40 is fixed to the partition plate 19, the discharge portion 42 is located in the heat exchange chamber 32, and the scroll portion 41 is located in the air-sending chamber 31.

As illustrated in FIG. 13, the tongue portion 43 of the scroll casing 40 is located close to the partition plate 19. Also, as illustrated in FIG. 13, in the centrifugal air-sending device 100, a portion forming the tongue portion 43 and the partition plate 19 may be fixed to each other, or the partition plate 19 and a portion between the tongue portion 43 and the discharge port 42*a* may be fixed each other.

As illustrated in FIG. 13, in the air-conditioning apparatus 140, two centrifugal air-sending devices 100 include respective fans 10 attached to an output shaft 51. Each of the centrifugal air-sending devices 100 including the fans 10 generates a flow of air that is sucked into the housing 16 through the housing suction port 18 and sent to an air-conditioning target space through the housing air outlet 17. It should be noted that the number of centrifugal air-sending devices 100 provided in the housing 16 is not limited to 2 but may be 1 or 3 or larger.

The scroll casing 40 has a circumferential wall 44*c* that is located to face the housing suction port 18. No other component is provided between the circumferential wall 44*c* and the housing suction port 18, and the circumferential wall 44*c* and the housing suction port 18 directly face each other.

(Driving Source 50)

The driving source 50 is, for example, a motor. The driving source 50 is supported by a motor support 9*a* fixed to the housing 16. The driving source 50 has the output shaft 51. The output shaft 51 is a motor shaft, and is provided to extend parallel to the outlet wall portion 16*c*1 having the housing air outlet 17.

(Heat Exchanger 15)

The heat exchanger 15 is located at such a position as to face the discharge port 42*a* of the centrifugal air-sending device 100 as described above, and in the housing 16, the heat exchanger 15 is located on an air passage for air that is sent from the centrifugal air-sending device 100. Air sent from the centrifugal air-sending device 100 passes through the heat exchanger 15. The heat exchanger 15 adjusts the temperature of air that is sucked into the housing 16 through the housing suction port 18 and is blown to an air-conditioning target space through the housing air outlet 17. It should be noted that as the heat exchanger 15, a heat exchanger having a well-known structure can be applied.

In the air-conditioning apparatus 140, the housing suction port 18, the scroll casing 40 of the centrifugal air-sending device 100, the heat exchanger 15, and the housing air outlet 17 are arranged in this order in a direction from the housing suction port 18 toward the housing air outlet 17 of the air-conditioning apparatus 140. In the case where the air-conditioning apparatus 140 is a ceiling-suspended air-conditioning apparatus, the above components are arranged in an inverted L manner.

(Relationship Between Housing 16 and Centrifugal Air-Sending Device 100)

Figure 14:
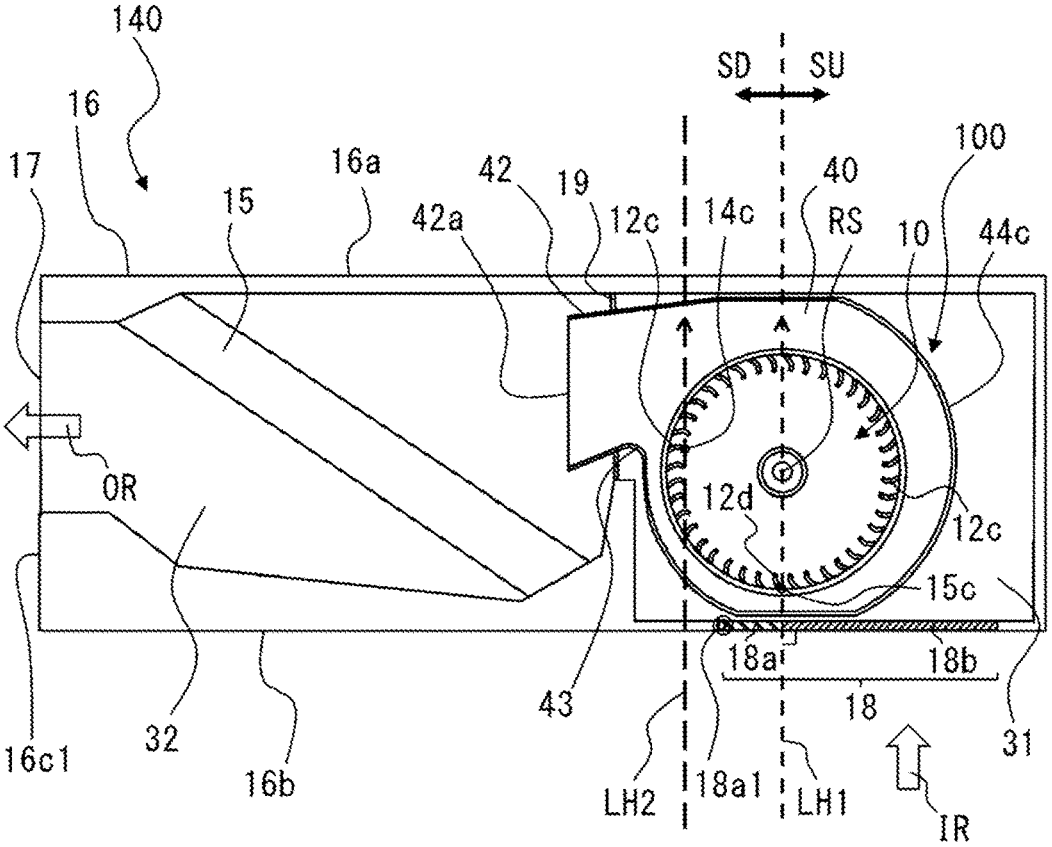
FIG. 14 is a side view conceptually illustrating an example of an internal configuration of the air-conditioning apparatus according to Embodiment 1.

FIG. 14 is a side view conceptually illustrating an example of an internal configuration of the air-conditioning apparatus 140 according to Embodiment 1. It should be noted that in FIG. 14, illustration of the side wall 44*a* is omitted in order to illustrate a relationship between the fan 10 and the tongue portion 43. Furthermore, FIG. 14 is also a sectional view conceptually illustrating a section of the fan 10 that is perpendicular to the axial direction along the rotation axis RS at a given position in the axial direction along the rotation axis RS. A relationship between the housing 16 and the centrifugal air-sending device 100 will be described in more detail with reference to FIG. 14.

As illustrated in FIG. 14, the housing 16 has an opening wall portion having the housing suction port 18, and the housing suction port 18 is located on a line crossing a direction in which the discharge port 42*a* extends. In the air-conditioning apparatus 140 according to Embodiment 1, the opening wall portion is the lower surface portion 16*b*. The housing suction port 18 of the air-conditioning apparatus 140 is provided at an angle of 90 degrees relative to the discharge port 42*a* of the centrifugal air-sending device 100, which is mounted in the apparatus.

As viewed in the axial direction along the rotation axis RS of the fan 10, in the radial direction of the rotation axis RS, a leading edge of a blade 12*c* of the plurality blades 12 that is the closest to the tongue portion 43 will be referred to as a first leading edge portion 14*c*. Furthermore, as viewed in the axial direction along the rotation axis RS of the fan 10, in the radial direction of the rotation axis RS, a trailing edge of a blade 12*d* of the plurality of blades 12 that is the closest to one of the wall portions of the housing 16 will be referred to as a first trailing edge portion 15*c*. In the air-conditioning apparatus 140 according to Embodiment 1, one of the wall portions of the housing 16 that is the closest to the blade 12*d* is the lower surface portion 16*b*.

The first trailing edge portion 15*c* corresponds to the trailing edge 15A1 of the first blade 12A or the trailing edge 15131 of the second blade 12B as illustrated in FIGS. 4 and 5. The first leading edge portion 14*c* corresponds to the leading edge 14A1 of the first turbo blade portion 12A2 or the leading edge 14B1 of the second turbo blade portion 12B2 as illustrated in FIGS. 4 and 5. Alternatively, the first leading edge portion 14*c* corresponds to the first sirocco leading edge 14A11 of the first sirocco blade portion 12A1 or the second sirocco leading edge 14B11 of the second sirocco blade portion 1261.

As illustrated in FIG. 14, as viewed in the axial direction along the rotation axis RS of the fan 10, a straight line that passes through the rotation axis RS and the first trailing edge portion 15*c* will be referred to as a first straight line LH1, and a straight line that is parallel to the first straight line LH1 and passes through the first leading edge portion 14*c* will be referred to as a second straight line LH2. In the case where the housing 16 is formed in the shape of a cuboid, the first straight line LH1 is a straight line that extends from the rotation axis RS in a direction perpendicular to the lower surface portion 16*b*.

Furthermore, as viewed in the axial direction along the rotation axis RS of the fan 10, a region that forms part of the housing suction port 18 that is located on a side SD on which the tongue portion 43 is formed, and which is one of opposite sides with respect to the rotation axis RS, will be referred to as a first region 18*a*. Furthermore, as viewed in the axial direction along the rotation axis RS of the fan 10, a region that forms part of the housing suction port 18 that is located on a side SU which is the opposite side of the side SD with respect to the rotation axis RS will be referred to as a second region 18*b*.

In the air-conditioning apparatus 140, a boundary portion 18*a*1 of the first region 18*a* that is the closest to the tongue portion 43 is located between the first straight line LH1 and the second straight line LH2. The boundary portion 18*a*1 is a boundary between the filter 21 and a decorative panel that forms the lower surface portion 16*b* located on the side SD where the tongue portion 43 is formed, relative to the rotation axis RS.

[Example of Operation of Air-Conditioning Apparatus 140]

When the fan 10 is rotated by driving of the driving source 50, air in the air-conditioning target space is sucked into the housing 16 through the housing suction port 18. The air sucked into the housing 16 flows along the bellmouth 46 and is sucked into the fan 10. The air sucked into the fan 10 is blown outwardly in the radial direction of the fan 10.

The pressure of the air blown from the fan 10 is raised while the air is passing through the inside of the scroll casing 40 which has a flow passage whose sectional area increases toward a downstream side with reference to the tongue portion 43. The air whose pressure is raised is blown from the discharge port 42*a* of the scroll casing 40 and is supplied to the heat exchanger 15. When passing through the heat exchanger 15, the air supplied to the heat exchanger 15 exchanges heat with a heat exchange medium such as refrigerant which flows in the heat exchanger 15, and is adjusted in temperature and humidity. After passing through the heat exchanger 15, the air is blown into the air-conditioning target space through the housing air outlet 17.

[Advantages of Air-Conditioning Apparatus 140]

Figure 15:
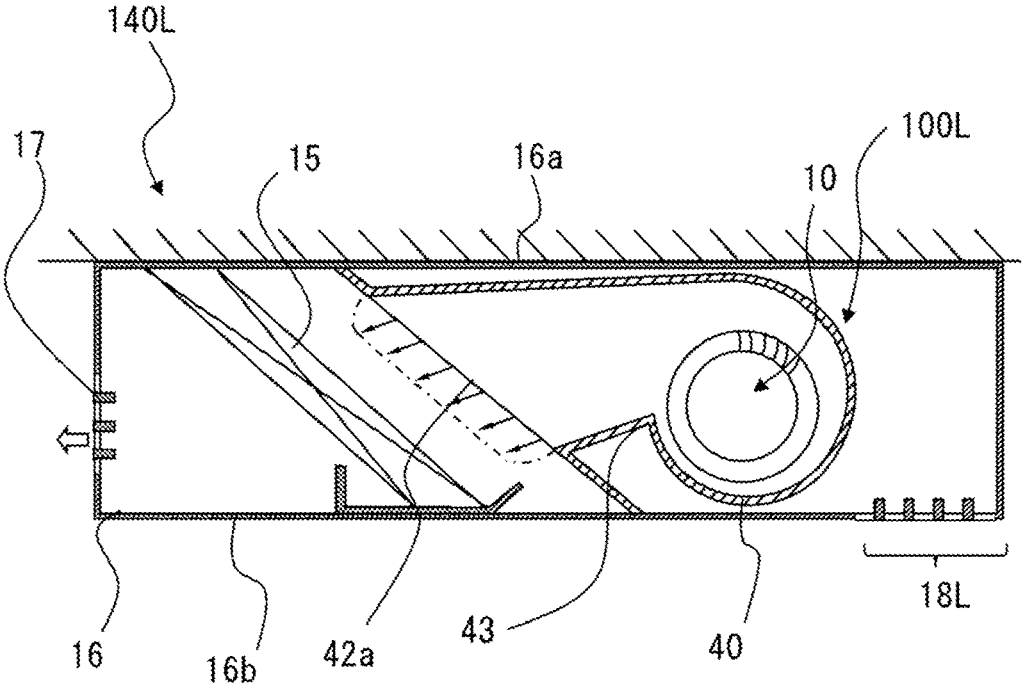
FIG. 15 is a side view conceptually illustrating an example of an internal configuration of an air-conditioning apparatus of a comparative example.

FIG. 15 is a side view conceptually illustrating an example of an internal configuration of an air-conditioning apparatus 140L of a comparative example. In order to reduce noise made from the tongue portion 43, as in the air-conditioning apparatus 140L of the comparative example, the air-conditioning apparatus 140L may have an air suction port 18L provided at a position located apart from the scroll casing 40 of a centrifugal air-sending device 100L. In this case, the housing 16 of the air-conditioning apparatus 140L is increased in size in order to ensure a given distance between the scroll casing 40 and the air suction port 18L.

Furthermore, in the case of reducing the space for installation of the air-conditioning apparatus 140L, the air-conditioning apparatus 140L is made smaller, as a result of which the air suction port 18L is provided closer to the scroll casing 40, and noise made from the tongue portion 43 easily leaks out to the outside through the air suction port 18L. Furthermore, in the case where the air suction port 18L is made smaller in order to reduce the space for installation of the air-conditioning apparatus 140L, although the noise from the tongue portion 43 does not easily leak out to the outside through the air suction port 18L, the amount of air that is sucked into the centrifugal air-sending device 100L is decreased. In this case, in the air-conditioning apparatus 140L, the heat exchange efficiency is reduced because the amount of air that is sent from the centrifugal air-sending device 100L and passes through the heat exchanger 15 is decreased.

In the air-conditioning apparatus 140 according to Embodiment 1, the boundary portion 18*a*1 of the first region 18*a* that is the closest to the tongue portion is located between the first straight line LH1 and the second straight line LH2. In the air-conditioning apparatus 140, in the case where the boundary portion 18*a*1 is provided at the above position and the housing 16 is made smaller, the boundary portion 18*a*1 is located apart from a position located under the tongue portion 43 in the vertical direction while it is ensured that the housing suction port 18 has a given size. Thus, the lower surface portion 16*b* covers the tongue portion 43 at a position located under the tongue portion 43 in the vertical direction. Therefore, in the air-conditioning apparatus 140, noise made by the tongue portion 43 can be attenuated by the lower surface portion 16*b*, which is a wall portion of the housing 16.

Furthermore, the first leading edge portion 14*c* corresponds to the leading edge 14A1 of the first turbo blade portion 12A2 or the leading edge 14B1 of the second turbo blade portion 12B2. In the case where the air-conditioning apparatus 140 has such a configuration, the lower surface portion 16*b* covers the tongue portion 43 at the position located under the tongue portion 43 in the vertical direction, and the lower surface portion 16*b* extends to a position that is located between the tongue portion 43 and the rotation axis RS and is close to the rotation axis RS. Therefore, in the air-conditioning apparatus 140, noise made by the tongue portion 43 can be further attenuated by the lower surface portion 16*b*, as compared with an air-conditioning apparatus not having the above configuration.

Embodiment 2

Figure 16:
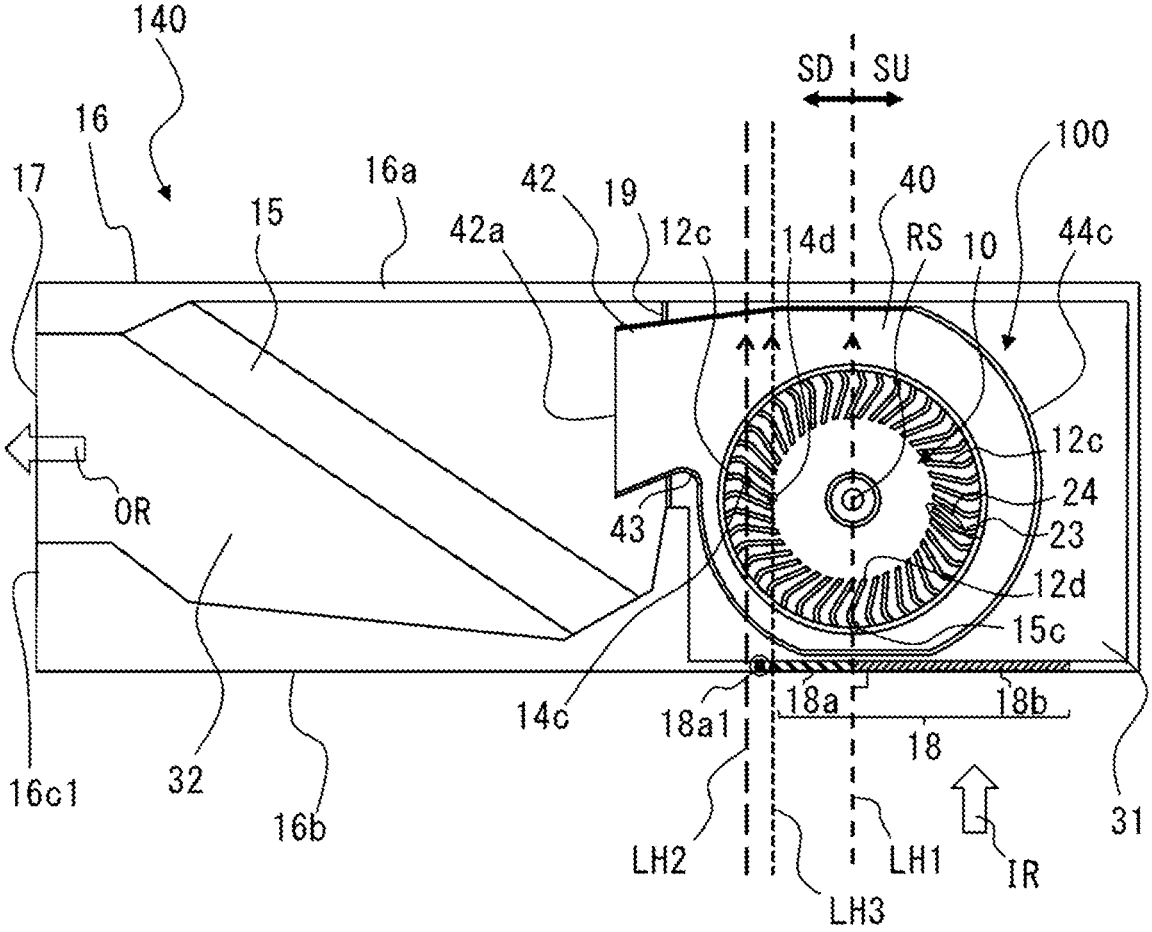
FIG. 16 is a side view conceptually illustrating an example of an internal configuration of an air-conditioning apparatus according to Embodiment 2.

FIG. 16 is a side view conceptually illustrating an example of an internal configuration of an air-conditioning apparatus 140 according to Embodiment 2. It should be noted that in FIG. 16, illustration of the side wall 44*a* is omitted in order to illustrate a relationship between the fan 10 and the tongue portion 43. Furthermore, FIG. 16 is also a sectional view conceptually illustrating a section of the fan 10 that is perpendicular to the axial direction along the rotation axis RS at a given position in the axial direction along the rotation axis RS. It should be noted that regarding Embodiment 2, components that are the same in configuration as those of the air-conditioning apparatus 140, etc., as illustrated in FIGS. 1 to 14 are denoted by the same reference signs, and their descriptions will thus be omitted.

In a centrifugal air-sending device 100 according to Embodiment 2, a relationship between the boundary portion 18*a*1 of the housing 16 and the leading edges of the sirocco blade portion and the turbo blade portion of the centrifugal air-sending device 100 according to Embodiment 1 is further specified. In FIG. 16, one or both of the first sirocco blade portion 12A1 and the second sirocco blade portion 12131 are illustrated as sirocco blade portions 23; and one or both of the first turbo blade portion 12A2 and the second turbo blade portion 12B2 are illustrated as turbo blade portions 24.

The first leading edge portion 14*c* corresponds to the first sirocco leading edge 14A11 of the first sirocco blade portion 12A1 or the second sirocco leading edge 14B11 of the second sirocco blade portion 12131. The first leading edge portion 14*c* is an innermost circumferential end portion of the sirocco blade portion 23. As illustrated in FIG. 16, as viewed in the axial direction along the rotation axis RS of the fan 10, a straight line that passes through the rotation axis RS and the first trailing edge portion 15*c* will be referred to as a first straight line LH1, and a straight line that is parallel to the first straight line LH1 and passes through the first leading edge portion 14*c* will be referred to as a second straight line LH2.

Furthermore, as viewed in the axial direction along the rotation axis RS of the fan 10, in the radial direction of the rotation axis RS, a leading edge of the turbo blade portion of the blade 12*c* of the plurality of blades 12 that is the closest to the tongue portion 43 will be referred to as a second leading edge portion 14*d*. The second leading edge portion 14*d* corresponds to the leading edge 14A1 of the first turbo blade portion 12A2 or the leading edge 14B1 of the second turbo blade portion 12B2 as illustrated in FIGS. 4 and 5. The second leading edge portion 14*d* is an innermost circumferential end portion of the turbo blade portion 24, and is a blade end that is close to the main plate 11.

As illustrated in FIG. 4, the leading edge 14A1 of the first turbo blade portion 12A2 or the leading edge 14B1 of the second turbo blade portion 12B2 is inclined relative to the rotation axis RS. It should be noted that the configuration of the leading edge 14A1 of the first turbo blade portion 12A2 and the leading edge 14B1 of the second turbo blade portion 12B2 is not limited to the above configuration but the leading edge 14A1 and the leading edge 14B1 may be parallel to the rotation axis RS.

As illustrated in FIG. 16, as viewed in the axial direction along the rotation axis RS of the fan 10, a line that is parallel to the first straight line LH1 and passes through the second leading edge portion 14*d* will be referred to as a third straight line LH3. The third straight line LH3 is also parallel to the second straight line LH2.

As illustrated in FIG. 16, in the air-conditioning apparatus 140, a boundary portion 18*a*1 of the first region 18*a* that is the closest to the tongue portion 43 is located between the second straight line LH2 and the third straight line LH3.

[Advantages of Air-Conditioning Apparatus 140]

The air-conditioning apparatus 140 according to Embodiment 2 includes the sirocco blade portions 23 and the turbo blade portions 24, and the boundary portion 18*a*1 is located between the second straight line LH2 and the third straight line LH3. In the air-conditioning apparatus 140, since the turbo blade portions 24 between which the inter-blade distance increases toward the outer circumference are provided at the leading edge sides of the blades 12, the pressure of air that flows into the fan 10 is raised and the velocity of the air is decreased by the turbo blade portions 24. Therefore, in the air-conditioning apparatus 140, it is possible to reduce the velocity of air that passes through the tongue portion 43, thereby reducing noise made from the tongue portion 43.

Furthermore, in the air-conditioning apparatus 140, the boundary portion 18*a*1 is provided closer to a side where the rotation axis RS is located than the first leading edge portion 14*c*, which is the leading edge of the sirocco blade portion 23. In addition, the boundary portion 18*a*1 is located closer to a side where the tongue portion 43 is located than the second leading edge portion 14*d*, which is the leading edge of the turbo blade portion 24. Thus, the blades 12 are exposed from the boundary portion 18*a*1 toward the filter 21, whereby it is possible to further ensure that a given amount of air is sucked into the housing 16, as compared with an air-conditioning apparatus not having the above configuration.

Furthermore, in the air-conditioning apparatus 140, in the case where the boundary portion 18*a*1 is provided at the above position and the housing 16 is made smaller, the boundary portion 18*a*1 is located at a positon located apart from a position located under the tongue portion 43 in the vertical direction, while it is ensured that the housing suction port 18 has a given size. Thus, the lower surface portion 16*b* covers the tongue portion 43 at the position located under the tongue portion 43 in the vertical direction. Therefore, in the air-conditioning apparatus 140, noise made by the tongue portion 43 can be attenuated by the lower surface portion 16*b*.

In addition, the leading edge of the turbo blade portion 24 is inclined relative to the rotation axis RS. In the air-conditioning apparatus 140, because of the above configuration, air that flows into the scroll casing 40 easily flows from the inner circumference of the fan 10 toward the outer circumference, and easily flows into the scroll casing, thereby increasing the amount of air that flows into the scroll casing.

Embodiment 3

Figure 17:
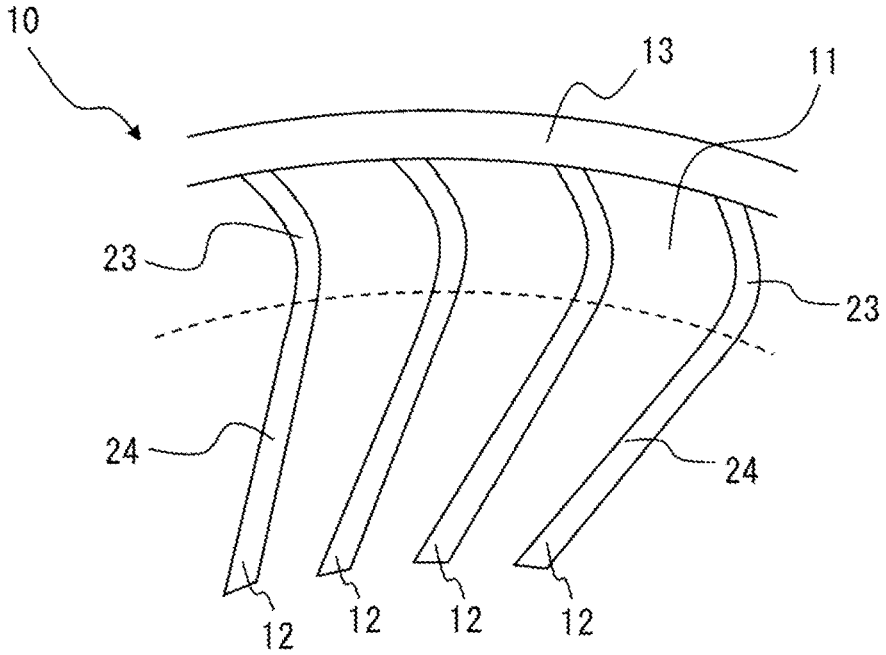
FIG. 17 is a partially enlarged view of a fan for use in the air-conditioning apparatus of the comparative example.
Figure 18:
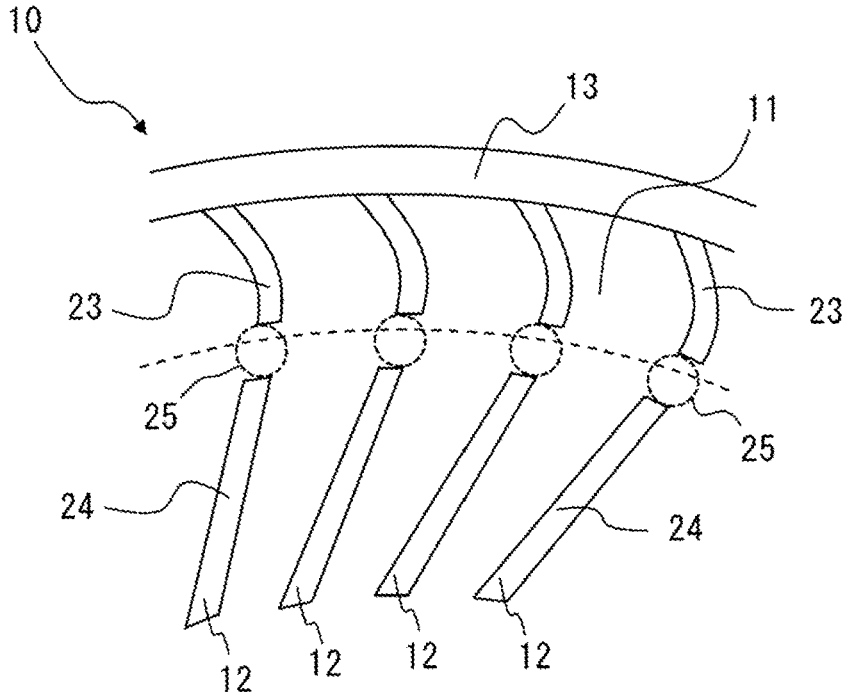
FIG. 18 is a partially enlarged view of a fan for use in an air-conditioning apparatus according to Embodiment 3.

FIG. 17 is a partially enlarged view of a fan 10 for use in the air-conditioning apparatus 140 of the comparative example. FIG. 18 is a partially enlarged view of a fan 10 for use in an air-conditioning apparatus 140 according to Embodiment 3. It should be noted that regarding Embodiment 3, components that are the same in configuration as those of the air-conditioning apparatus 140, etc., as illustrated in FIGS. 1 to 16 are denoted by the same reference signs, and their descriptions will thus be omitted. In the air-conditioning apparatus 140 according to Embodiment 3, the configuration of the fan 10 of the centrifugal air-sending device 100 according to Embodiment 1 or 2 is further specified.

The air-conditioning apparatus 140 of the comparative example as illustrated in FIG. 17 is the air-conditioning apparatus 140 according to Embodiment 1 or 2, and the blades 12 of the fan 10 for use in the apparatus are configured such that the sirocco blade portions 23 and the turbo blade portions 24 are formed integrally with each other as illustrated in FIG. 17. It should be noted that a dotted line along the circumferential direction of the fan 10 as illustrated in FIG. 17 indicates a boundary between the sirocco blade portions 23 and the turbo blade portions 24.

As illustrated in FIG. 18, the blades 12 of the fan 10 for use in the air-conditioning apparatus 140 according to Embodiment 3 are configured such that in the radial direction, the sirocco blade portions 23 and the turbo blade portions 24 are separated from each other. In the radial direction perpendicular to the rotation axis RS, at the blades 12, separating portions 25 are provided between the sirocco blade portions 23 and the turbo blade portions 24. It should be noted that a dotted line along the circumferential direction of the fan 10 as illustrated in FIG. 18 indicates a boundary between the sirocco blade portions 23 and the turbo blade portions 24 in the case the sirocco blade portions 23 and the turbo blade portions 24 are formed integrally with each other.

The separating portions 25 are through-holes that extend through the blades 12 in the circumferential direction around the rotation axis RS, and are portions that, in the axial direction along the rotation axis RS, are recessed from end portions of the blades 12 that adjoin the side plate 13 toward the main plate 11. The separating portions 25 may be formed only in the side-plate-side blade region 122*b* which is the second region as illustrated in FIG. 9, or may be formed continuous with the main-plate-side blade region 122*a* which is the first region and the side-plate-side blade region 122*b* which is the second region. In the case where the separating portions 25 are formed in the main-plate-side blade region 122*a* and the side-plate-side blade region 122*b*, the bottom of each of the separating portions 25 in the axial direction along the rotation axis RS may be the main plate 11.

[Advantages of Air-Conditioning Apparatus 140]

The air-conditioning apparatus 140 according to Embodiment 3 can reduce a loss caused by the flow of air into the sirocco blade portions 23, as the turbo blade portions 24 and the sirocco blade portions 23 are separated from each other. The air-conditioning apparatus 140 can reduce a loss because the sirocco blade portions 23, which are located behind the turbo blade portions 24, collect air that leaks out from the turbo blade portions 24 and flows to a region located behind the turbo blade portions 24. Furthermore, the air-conditioning apparatus 140 according to Embodiment 3 has a similar configuration to that of the air-conditioning apparatuses 140 according to Embodiments 1 and 2, and can thus obtain advantages that are similar to those of the air-conditioning apparatuses 140 according to Embodiments 1 and 2.

Embodiment 4

Figure 19:
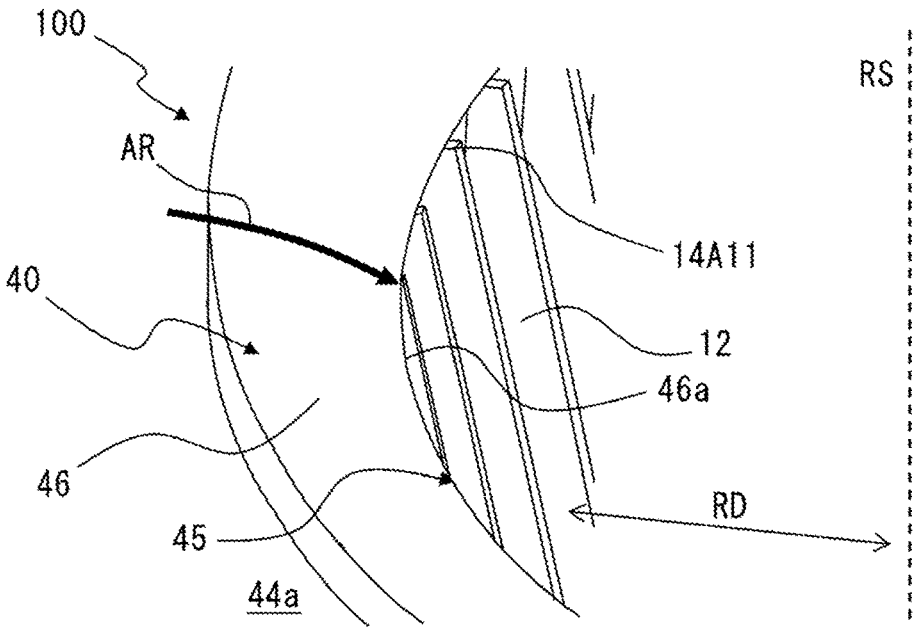
FIG. 19 is a partially enlarged perspective view of a centrifugal air-sending device for use in an air-conditioning apparatus according to Embodiment 4.
Figure 20:
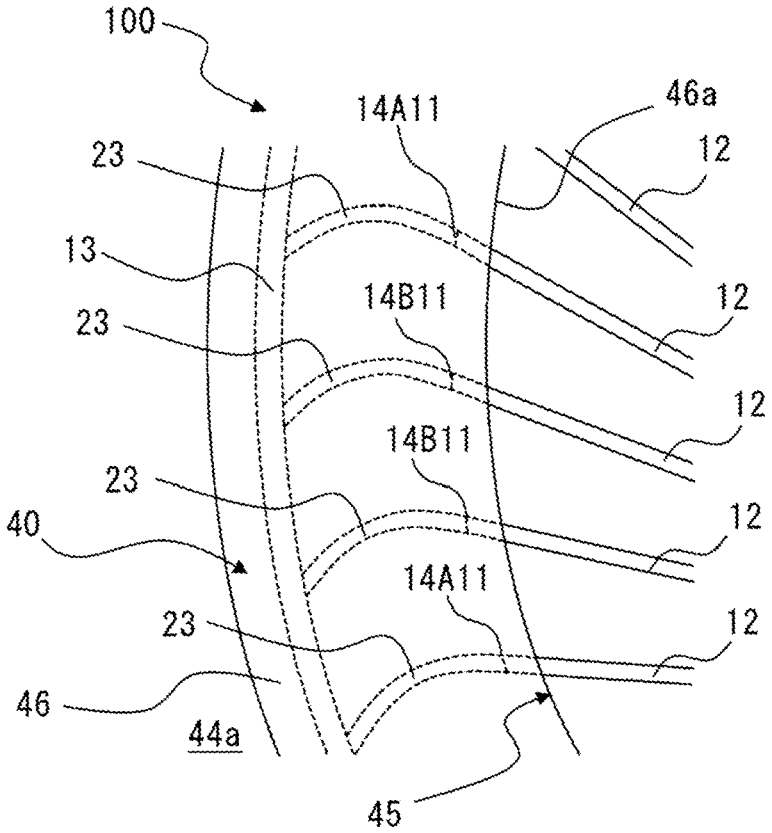
FIG. 20 is a partially enlarged view of the centrifugal air-sending device for use in the air-conditioning apparatus according to Embodiment 4.

FIG. 19 is a partially enlarged perspective view of a centrifugal air-sending device 100 for use in an air-conditioning apparatus 140 according to Embodiment 4. FIG. 20 is a partially enlarged view of the centrifugal air-sending device 100 for use in the air-conditioning apparatus 140 according to Embodiment 4. An arrow AR as illustrated in FIG. 19 indicates the flow of air. Furthermore, in order to explain a relationship between the bellmouth 46 and the blades 12, in FIG. 20, dotted lines are used to indicate portions of the blades 12 that are located below the bellmouth 46. Furthermore, regarding Embodiment 4, components that are the same in configuration as those of the air-conditioning apparatus 140, etc., as illustrated in FIGS. 1 to 18, will be denoted by the same reference signs, and their descriptions will thus be omitted. In the air-conditioning apparatus 140 according to Embodiment 4, the relationship between the bellmouth 46 and the blades 12 is further specified.

As illustrated in FIGS. 19 and 20, the side wall 44*a* of the centrifugal air-sending device 100 includes the bellmouth 46, which smoothly guides air into the scroll casing 40 through the bellmouth 46. The bellmouth 46 has inner circumferential edge portions 46*a* that define the suction ports 45, and the inner circumferential edge portions 46*a* are formed closer to the inner circumference than the leading edges of the sirocco blade portions 23 in the radial direction RD of the rotation axis RS.

The inner circumferential edge portion 46*a* of the bellmouth 46 is an edge portion that, in the radial direction perpendicular to the rotation axis RS, forms an inner circumferential end portion of the bellmouth 46, and is formed circularly around the rotation axis RS. The leading edges of the sirocco blade portions 23 are first sirocco leading edges 14A11 and second sirocco blade portions 14B11. In the case where the fan 10 has blades 12 that are either first blades 12A or second blades 12B, the leading edges of the sirocco blade portions 23 are first sirocco leading edges 14A11 or second sirocco leading edges 14B11.

[Advantages of Air-Conditioning Apparatus 140]

In the air-conditioning apparatus 140 according to Embodiment 4, the inner circumferential edge portion 46*a* of the bellmouth 46 that defines the suction port 45 is located closer to the inner circumference than the leading edges of the sirocco blade portions 23 in the radial direction RD. By virtue of such a configuration, the outer circumference of the fan 10, where the velocity of air is increased, is covered with the bellmouth 46, and the air-conditioning apparatus 140 according to Embodiment 4 can thus further reduce noise, as the compared with an air-conditioning apparatus not having the above configuration.

Embodiment 5

Figure 21:
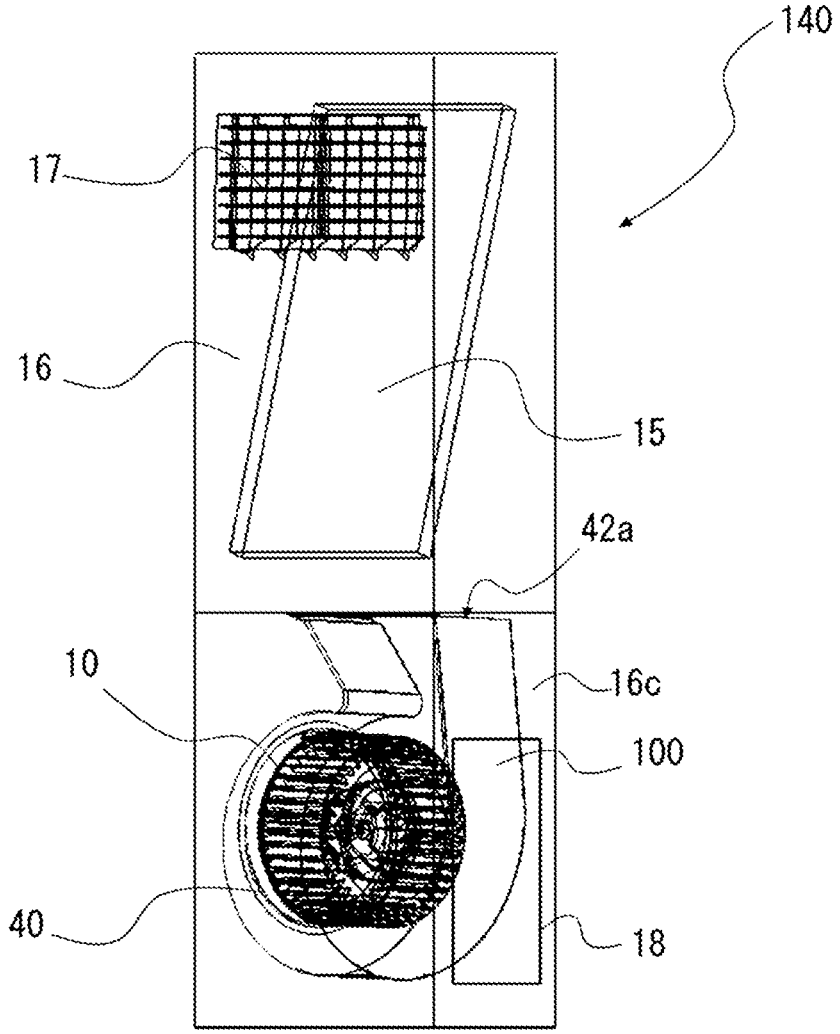
FIG. 21 is a perspective view of an air-conditioning apparatus according to Embodiment 5.
Figure 22:
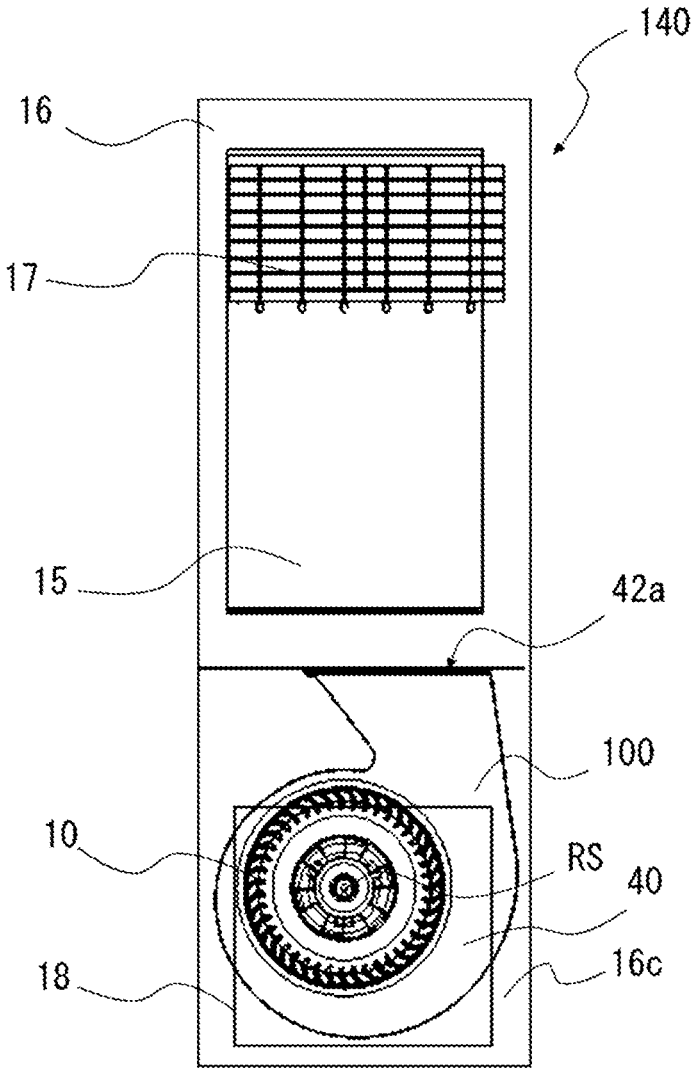
FIG. 22 is a perspective view of a modification of the air-conditioning apparatus according to Embodiment 5.
Figure 23:
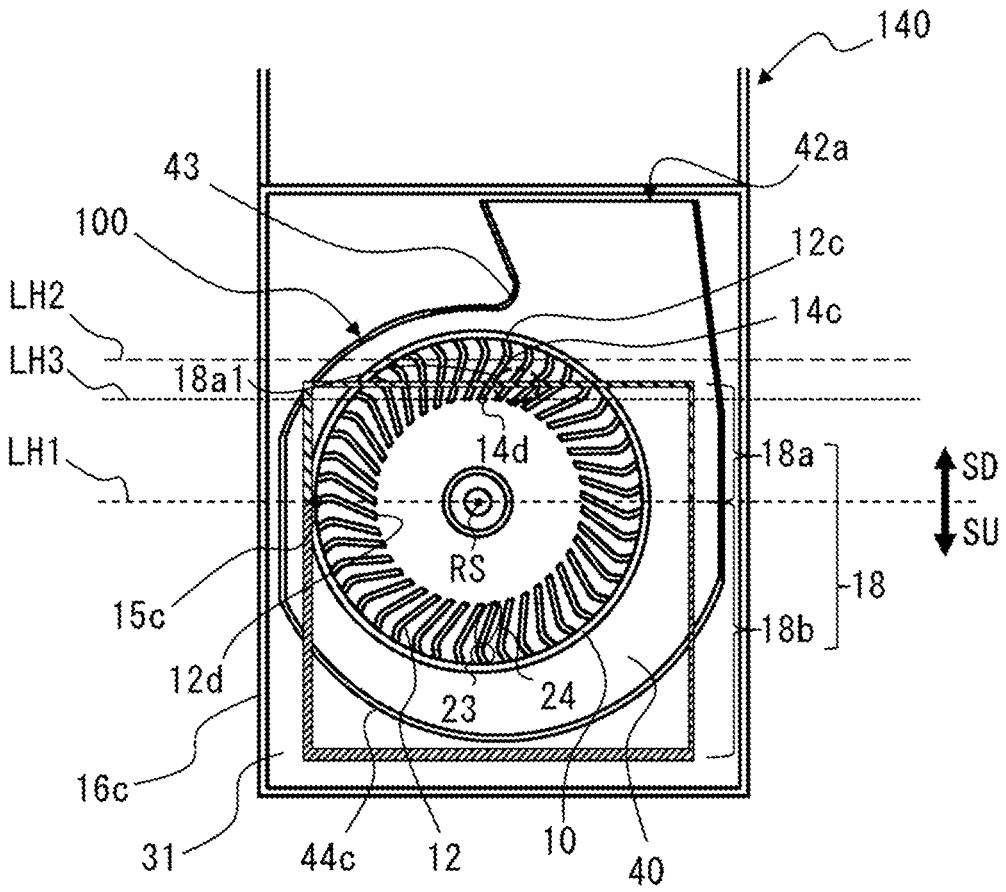
FIG. 23 is a partially enlarged view of a portion of the air-conditioning apparatus as illustrated in FIG. 22 in which a centrifugal air-sending device for use in the air-conditioning apparatus is provided.

FIG. 21 is a perspective view of an air-conditioning apparatus 140 according to Embodiment 5. FIG. 22 is a perspective view of a modification of the air-conditioning apparatus 140 according to Embodiment 5. FIG. 23 is a partially enlarged view of a portion of the air-conditioning apparatus 140 as illustrated in FIG. 22 in which a centrifugal air-sending device 100 for use in the air-conditioning apparatus 140 is provided. It should be noted that FIGS. 21 to 23 directly illustrate the heat exchanger and the centrifugal air-sending device 100 provided in the housing 16 without illustrating the panels of the housing 16, in order that the internal configuration be described. Furthermore, the air-conditioning apparatus 140 according to Embodiment as illustrated in FIG. 21 and the modification thereof illustrated in FIG. 22 are different from each other in the orientation of the centrifugal air-sending device 100 and the location of the housing suction port 18.

Although each of the air-conditioning apparatuses 140 according to Embodiments 1 to 4 is described above as a ceiling-suspended apparatus that is suspended from a ceiling, the air-conditioning apparatus 140 may be a floor-standing apparatus as in the air-conditioning apparatus 140 according to Embodiment 5 as illustrated in FIG. 21. In the air-conditioning apparatus 140 according to Embodiment 5, the housing suction port 18 and the housing air outlet 17 are formed in the side surface portion 16*c* of the housing 16. Although in the air-conditioning apparatus 140 according to Embodiment as illustrated in FIG. 21, the housing suction port 18 and the housing air outlet 17 are formed in different side surfaces of the housing 16, whereas in the modification of the air-conditioning apparatus 140 as illustrated in FIG. 22, the housing suction port 18 and the housing air outlet 17 are formed in the same side surface of the housing 16.

Furthermore, in each of the air-conditioning apparatuses 140 according to Embodiments 1 to 4, the housing suction port 18 (see FIG. 14) of the air-conditioning apparatus 140 is formed at a position parallel to the rotation axis RS of the fan 10. The configuration of the air-conditioning apparatus 140 is not limited to the above configuration, and the housing suction port 18 may be formed at a position perpendicular to the rotation axis RS of the fan 10, as in the air-conditioning apparatus 140 according to Embodiment 5 as illustrated in FIGS. 21 to 23. It should be noted that in the air-conditioning apparatus 140 of Embodiment 5, the first straight line LH1 is a line that extends from the rotation axis RS in a direction perpendicular to the side surface portion 16*c*. In the air-conditioning apparatus 140 according to Embodiment 5, the side surface portions 16*c* are side walls of the housing 16, and are walls located on respective sides with reference to the opening wall portion in which the housing suction port 18 is formed.

[Advantages of Air-Conditioning Apparatus 140]

The conditioning apparatus 140 according to Embodiment is a flood-standing apparatus, but has a similar configuration to those of the air-conditioning apparatuses 140 according to Embodiments 1 to 4, and can therefore obtain similar advantages to those of the air-conditioning apparatuses 140 according to Embodiments 1 to 4.

It should be noted that the above descriptions concerning Embodiments 1 to 5 are each made by referring to by way of example the air-conditioning apparatus 140 including the centrifugal air-sending device 100 provided with the double-suction fan 10 in which the plurality of blades 12 are formed on the both sides of the main plate 11. However, each of Embodiments 1 to 5 is also applicable to an air-conditioning apparatus 140 including a centrifugal air-sending device 100 provided with a single-suction fan 10 in which the plurality of blades 12 are formed only on one side of the main plate 11.

Embodiments 1 to 5 can be put to practical use in combination. Furthermore, the configurations described regarding the embodiments are examples and can be combined with another well-known technique, and part of each of the configurations may be omitted or changed without departing from the gist of the embodiments.

REFERENCE SIGNS LIST

9*a*: motor support, 10: fan, 10*a*: outer circumferential side surface, 10*e*: suction port, 11: main plate, 11*b*: boss portion, 11*b*1: shaft hole, 12: blade, 12A: first blade, 12A1: first sirocco blade portion, 12A11: first sirocco region, 12A2: first turbo blade portion, 12A21: first turbo region, 12A3: first radial blade portion, 12B: second blade, 1261: second sirocco blade portion, 12B11: second sirocco region, 12B2: second turbo blade portion, 12B21: second turbo region, 1263: second radial blade portion, 12*c*: blade, 12*d*: blade, 13: side plate, 13*a*: first side plate, 13*b*: second side plate 14A: inner circumferential end, 14A1: leading edge, 14A11: first sirocco leading edge, 14B: inner circumferential end, 14B1: leading edge, 14B11: second sirocco leading edge, 14*c*: first leading edge portion, 14*d*: second leading edge portion, 15: heat exchanger, 15A: outer circumferential end, 15A1: trailing edge, 15B: outer circumferential end, 15B1: trailing edge, 15*c*: first trailing edge portion, 16: housing, 16*a*: upper surface portion, 16*b*: lower surface portion, 16*c*: side surface portion, 16*c*1: outlet wall portion, 17: housing air outlet, 18: housing suction port, 18L: air suction port, 18*a*: first region, 18*a*1: boundary portion, 18*b*: second region, 19: partition plate, 21: filter, 23: sirocco blade portion, 24: turbo blade portion, 25: separating portion, 31: air-sending chamber, 32: heat exchange chamber, 40: scroll casing, 41: scroll portion, 41*a*: scroll start portion, 41*b*: scroll end portion, 42: discharge portion, 42*a*: discharge port, 42*b*: extension plate, 42*c*: diffuser plate, 42*d*: first side plate portion, 42*e*: second side plate portion, 43: tongue portion, 44*a*: side wall, 44*c*: circumferential wall, 45: suction port, 46: bellmouth, 46*a*: inner circumferential edge portion, 50: driving source, 51: output shaft, 71: first plane, 72: second plane, 100: centrifugal air-sending device, 100L: centrifugal air-sending device, 112*a*: first blade portion, 112*b*: second blade portion, 122*a*: main-plate-side blade region, 122*b*: side-plate-side blade region, 140: air-conditioning apparatus, 140L: air-conditioning apparatus, 141A: inclined portion, 141B: inclined portion, AR: arrow, C1: circle, C2: circle, C3: circle, C4: circle, C5: circle, C7: circle, C8: circle, CD: circumferential direction, CL1: center line, CL2: center line, CL3: center line, CL4: center line, ID1: inside diameter, ID2: inside diameter, ID3: inside diameter, ID4: inside diameter, IR: arrow, Lie: blade length, L1*b*: blade length, L2*a*: blade length, L2*b*: blade length, LH1: first straight line, LH2: second straight line, LH3: third straight line, MP: middle position, OD1: outside diameter, OD2: outside diameter, OD3: outside diameter, OD4: outside diameter, OR: arrow, R: rotation direction, RD: radial direction, RS: rotation axis, SD: side, SU: side, TL1: tangent line, TL2: tangent line, TL3: tangent line, TL4: tangent line, W: width dimension, $\alpha$1: blade outlet angle, $\alpha$2: blade outlet angle, $\beta$1: blade outlet angle, $\beta$2: blade outlet angle

The invention claimed is:

1. An air-conditioning apparatus comprising:

a centrifugal air-sending device including a fan and a scroll casing, the fan including a main plate that is driven to rotate and a plurality of blades provided at a circumferential edge portion of the main plate, the scroll casing accommodating the fan and including a circumferential wall and a side wall, the circumferential wall being formed in the shape of a scroll, the side wall having a suction port that communicates with a space defined by the main plate and the plurality of blades;

a heat exchanger through which an air current generated from the centrifugal air-sending device passes; and a housing that houses the centrifugal air-sending device and the heat exchanger, and has a housing suction port through which air is sucked into the centrifugal air-sending device and a housing air outlet through which air that is sent from the centrifugal air-sending device and passes through the heat exchange flows out from the housing, wherein the scroll casing has: a tongue portion located at a position from which the circumferential wall extends to be formed in the shape of the scroll, the tongue portion being configured to divide a flow of air blown from the fan; and a discharge portion having a discharge port through which air blown from the fan flows out, wherein the housing has an opening wall portion having the housing suction port, and the housing suction port is located on a line crossing a direction in which the discharge port extends, and wherein where as viewed in a direction along a rotation axis of the fan, in a radial direction perpendicular to the rotation axis, a trailing edge of one of the plurality of blades that is located closest to a wall portion of the housing is defined as a first trailing edge portion, and a leading edge of one of the plurality of blades that is located closest to the tongue portion is defined as a first leading edge portion, a straight line that passes through the rotation axis and the first trailing edge portion is defined as a first straight line, and a straight line that is parallel to the first straight line and passes through the first leading edge portion is defined as a second straight line, and a region that forms part of the housing suction opening that is close to the tongue portion with reference to the rotation axis is defined as a first region, a boundary portion of the first region that is located closest to the tongue portion is located between the first straight line and the second straight line, each of the plurality of blades includes an inner circumferential end located close to the rotation axis in the radial direction, an outer circumferential end located closer to an outer circumference than the inner circumferential end in the radial direction, a sirocco blade portion including the outer circumferential end and formed as a forward-swept blade portion having a blade outlet angle of greater than 90 degrees, and a turbo blade portion including the inner circumferential end and formed as a backward-swept blade portion, the first leading edge portion is a leading edge of the turbo blade portion, and the turbo blade portion and the sirocco blade portion are formed integrally with each other.

2. The air-conditioning apparatus of claim 1, wherein the leading edge of the turbo blade portion is inclined relative to the rotation axis.

3. The air-conditioning apparatus of claim 1, wherein at the side wall, a bellmouth configured to smoothly guide air into the scroll casing is provided, and the bellmouth has an inner circumferential edge portion defining the suction port and located closer to an inner circumference than the leading edge of the sirocco blade portion in the radial direction.

4. An air-conditioning apparatus comprising:

a centrifugal air-sending device including a fan and a scroll casing, the fan including a main plate that is driven to rotate and a plurality of blades provided at a circumferential edge portion of the main plate, the scroll casing accommodating the fan and including a circumferential wall and a side wall, the circumferential wall being formed in the shape of a scroll, the side wall having a suction port that communicates with a space defined by the main plate and the plurality of blades;

a heat exchanger through which an air current generated from the centrifugal air-sending device passes; and a housing that houses the centrifugal air-sending device and the heat exchanger, and has a housing suction port through which air is sucked into the centrifugal air-sending device and a housing air outlet through which air that is sent from the centrifugal air-sending device and passes through the heat exchange flows out from the housing, wherein the scroll casing has: a tongue portion located at a position from which the circumferential wall extends to be formed in the shape of the scroll, the tongue portion being configured to divide a flow of air blown from the fan; and a discharge portion having a discharge port through which air blown from the fan flows out, wherein the housing has an opening wall portion having the housing suction port, and the housing suction port is located on a line crossing a direction in which the discharge port extends, and wherein where as viewed in a direction along a rotation axis of the fan, in a radial direction perpendicular to the rotation axis, a trailing edge of one of the plurality of blades that is located closest to a wall portion of the housing is defined as a first trailing edge portion, and a leading edge of one of the plurality of blades that is located closest to the tongue portion is defined as a first leading edge portion, a straight line that passes through the rotation axis and the first trailing edge portion is defined as a first straight line, and a straight line that is parallel to the first straight line and passes through the first leading edge portion is defined as a second straight line, and a region that forms part of the housing suction opening that is close to the tongue portion with reference to the rotation axis is defined as a first region, a boundary portion of the first region that is located closest to the tongue portion is located between the first straight line and the second straight line, each of the plurality of blades includes an inner circumferential end located close to the rotation axis in the radial direction, an outer circumferential end located closer to an outer circumference than the inner circumferential end in the radial direction, a sirocco blade portion including the outer circumferential end and formed as a forward-swept blade portion having a blade outlet angle of greater than 90 degrees, and a turbo blade portion including the inner circumferential end and formed as a backward-swept blade portion, the first leading edge portion is a leading edge of the sirocco blade portion, and the turbo blade portion and the sirocco blade portion are formed integrally with each other.

5. The air-conditioning apparatus of claim 4, wherein where as viewed in the axial direction, in the radial direction, a leading edge of the turbo blade portion of the one of the plurality of blades that is located closest to the tongue portion is defined as a second leading edge portion, and a straight line that is parallel to the first straight line and passes through the second leading edge portion is defined as a third straight line, the boundary portion is located between the second straight line and the third straight line.

* * * * *